US009266338B2

(12) United States Patent
Tsukahara et al.

(10) Patent No.: US 9,266,338 B2
(45) Date of Patent: Feb. 23, 2016

(54) LIQUID SUPPLY APPARATUS FOR SUPPLYING LIQUID TO A LIQUID JET HEAD AND LIQUID CONTAINER

(71) Applicant: SEIKO EPSON CORPORATION, Tokyo (JP)

(72) Inventors: Katsutomo Tsukahara, Matsumoto (JP); Takashi Mano, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/201,151

(22) Filed: Mar. 7, 2014

(65) Prior Publication Data

US 2014/0253645 A1 Sep. 11, 2014

(30) Foreign Application Priority Data

Mar. 7, 2013 (JP) ..... 2013-046036

(51) Int. Cl.
*B41J 2/175* (2006.01)
*B41J 29/02* (2006.01)

(52) U.S. Cl.
CPC ..... *B41J 2/17509* (2013.01); *B41J 2/17523* (2013.01); *B41J 29/02* (2013.01); *B41J 2002/17516* (2013.01)

(58) Field of Classification Search
CPC .. B41J 2/17523; B41J 2/1752; B41J 2/17503; B41J 2/17513; B41J 2/17533; B41J 2/17509; B41J 2/17553
See application file for complete search history.

(56) References Cited

U.S. PATENT DOCUMENTS

| | | | | |
|---|---|---|---|---|
| 5,523,780 | A | 6/1996 | Hirosawa et al. | |
| 6,843,558 | B2 * | 1/2005 | Seino | 347/85 |
| 7,008,051 | B2 | 3/2006 | Akermalm | |
| 2004/0046842 | A1 | 3/2004 | Rhee | |
| 2006/0290753 | A1 | 12/2006 | Tatsumi et al. | |
| 2008/0316282 | A1 | 12/2008 | Osawa et al. | |

FOREIGN PATENT DOCUMENTS

| | | | |
|---|---|---|---|
| JP | 60-034445 | U | 3/1985 |
| JP | 01-133749 | A | 5/1989 |
| JP | 06-008463 | A | 1/1994 |
| JP | 2000-006435 | A | 1/2000 |
| JP | 2001-150691 | A | 6/2001 |
| JP | 2001-232812 | A | 8/2001 |
| JP | 2005-518974 | A | 6/2005 |
| JP | 2007-007902 | A | 1/2007 |
| JP | 2007-313785 | A | 12/2007 |
| JP | 2009-202346 | A | 9/2009 |
| JP | 2012-111167 | A | 6/2012 |
| JP | 2012-183830 | A | 9/2012 |
| WO | 97/42035 | A1 | 11/1997 |

* cited by examiner

*Primary Examiner* — Juanita D Jackson
(74) *Attorney, Agent, or Firm* — Stroock & Stroock & Lavan LLP

(57) ABSTRACT

A liquid supply apparatus and a liquid container that allow a liquid outlet portion and a liquid inlet portion to be readily connected to each other are provided. An ink supply apparatus for supplying ink to an inkjet printer includes: an ink container that has an ink bag, and an ink outlet portion in communication with the ink bag; a right recess portion and a left recess portion that support the ink container; an ink inlet needle that can be connected to the ink outlet portion; and a connection tube that connects the ink inlet needle and the inkjet printer. The ink container is detachably supported by the right recess portion and the left recess portion such that the ink outlet portion is positioned on the upper side in the gravity direction of the ink bag.

20 Claims, 22 Drawing Sheets

LIQUID SUPPLY APPARATUS FOR SUPPLYING LIQUID TO A LIQUID JET HEAD AND LIQUID CONTAINER

BACKGROUND

1. Technical Field

The present invention relates to, for example, a liquid supply apparatus for supplying liquid such as ink to a liquid-jet device such as an inkjet printer, and a liquid container included in the liquid supply apparatus.

2. Related Art

In the related art, an inkjet printer that performs printing by jetting ink from its recording head onto paper or the like is known as a type of liquid-jet device. In order to stably supply ink continuously to the recording head when performing a relatively large amount of printing, this sort of printer may be connected to an external ink supply apparatus (liquid supply apparatus) (Refer to, for example, JP-A-2009-202346).

Such an external ink supply apparatus includes: an external ink pack with a relatively large volume for containing ink; a hanging mechanism for hanging the ink pack; and an ink supply tube. In a state where the ink pack is hanged from the hanging mechanism, the ink supply tube is disposed such that one of the ends is connected to a printer-side ink tank, and the other end is connected via an opening/closing valve to a connecting portion of the ink pack on the lower side in the vertical direction. Accordingly, ink inside the ink pack is supplied through the ink supply tube to the printer-side ink tank.

Incidentally, in the external ink supply apparatus as described above, the connecting portion of the ink pack, to which the other end of the ink supply tube is connected via the opening/closing valve, is positioned on the lower side in the vertical direction of the ink pack. Accordingly, it is difficult to look at the connecting portion of the ink pack and the opening/closing valve when connecting the other end of the ink supply tube via the opening/closing valve to the connecting portion of the ink pack, resulting in the problem that connecting the other end of the ink supply tube via the opening/closing valve to the connecting portion of the ink pack is difficult.

Note that such a problem is not limited to the external ink supply apparatus as described above, but is a substantially common problem to liquid supply apparatuses.

SUMMARY

An advantage of some aspects of the invention is to provide a liquid supply apparatus and a liquid container that allow a liquid outlet portion and a liquid inlet portion to be readily connected to each other.

Hereinafter, means for solving the above-described problem and advantageous effects thereof will be described.

In order to solve the above-described problem, an aspect of the invention is directed to a liquid supply apparatus for supplying liquid to a liquid-jet device, including: a liquid container that has a liquid containing portion at least partially having a flexible portion, and a liquid outlet portion in communication with the liquid containing portion; a support portion that supports at least part of the liquid container; a liquid inlet portion that can be connected to the liquid outlet portion; and a channel member that connects the liquid inlet portion and the liquid-jet device. The liquid container is detachably supported by the support portion such that liquid outlet portion is positioned on the upper side in the gravity direction of the liquid containing portion.

With this configuration, the liquid outlet portion is positioned on the upper side in the gravity direction of the liquid containing portion. Thus, the liquid outlet portion and the liquid inlet portion can be readily and reliably connected to each other while looking at these portions to be connected.

Typically, liquid is collected under its own weight in the lower portion. Thus, if the liquid outlet portion is at the lower portion, the liquid leakage amount may increase when a connection failure occurs between the liquid outlet portion and the liquid inlet portion. However, according to the above-described configuration, the liquid outlet portion is positioned on the upper side in the gravity direction of the liquid containing portion, and, thus, the liquid leakage amount can be suppressed even when a connection failure occurs between the liquid outlet portion and the liquid inlet portion.

It is preferable that, in this liquid supply apparatus, the liquid containing portion is a bag member having flexible walls facing each other, and is formed such that the facing walls approach each other as the liquid is consumed.

With this configuration, the state of liquid consumed can be easily known by looking at the state of the flexible wall displaced as the liquid is consumed.

It is preferable that this liquid supply apparatus further includes a casing that accommodates the liquid container and is provided with the support portion, wherein the casing includes: a bottom wall; an opening portion that faces the bottom wall and is formed above the bottom wall in the gravity direction; and a lid member that covers the opening portion in an openable/closable manner; and the liquid container is detachably accommodated into the casing through the opening portion.

With this configuration, the liquid container is attached to and detached from the casing through the opening portion that is formed on the upper side in the gravity direction of the casing. Thus, the liquid container can be readily attached to and detached from the casing.

Moreover, after the liquid container is accommodated into the casing, the opening portion can be covered by the lid member. Thus, damage to the liquid container and the channel member and accidental disconnection of the liquid outlet portion from the liquid inlet portion can be prevented. Accordingly, a supply failure of liquid and contamination with liquid can be prevented.

Furthermore, the liquid outlet portion and the liquid inlet portion can be connected and disconnected above the casing having the bottom face. Thus, even when liquid drops, the liquid droplets can be received by the casing. Accordingly, contamination outside the casing with liquid can be suppressed.

It is preferable that this liquid supply apparatus further includes a casing that accommodates the liquid container and is provided with the support portion, wherein the casing has a see-through portion through which a state of the flexible portion of the liquid containing portion displaced as the liquid inside the liquid container is consumed can be seen.

With this configuration, the casing has the see-through portion. Thus, the state of the liquid container deformed in the casing can be seen from the outside of the casing. Accordingly, the degree of liquid consumed can be checked from the outside of the casing.

It is preferable that this liquid supply apparatus further includes a casing that accommodates the liquid container and is provided with the support portion, wherein the casing includes: a first peripheral wall facing the liquid-jet device; a second peripheral wall facing the first peripheral wall; a third peripheral wall and a fourth peripheral wall intersecting the first peripheral wall and the second peripheral wall; a bottom wall intersecting the first peripheral wall, the second peripheral wall, the third peripheral wall, and the fourth peripheral wall; and an opening portion provided on the side facing the bottom wall; and a distance between the first peripheral wall and the second peripheral wall of the casing is smaller than a width at an end portion of the liquid container on the side where the liquid outlet portion is formed.

With this configuration, the distance between the first peripheral wall and the second peripheral wall of the casing is smaller than the width at the end portion of the liquid container on the side where the liquid outlet portion is formed, and, thus, the size of the casing can be reduced.

It is preferable that, in this liquid supply apparatus, the liquid outlet portion of the liquid container is formed at an end portion of the liquid containing portion, and the liquid container includes, at an end portion thereof on the side where the liquid outlet portion is formed, a liquid container support portion that is supported by the support portion.

With this configuration, the liquid container has the liquid container support portion. Thus, the liquid container can be handled while holding the liquid container support portion. Accordingly, the liquid container can be readily attached to and detached from the support portion.

It is preferable that, in this liquid supply apparatus, the liquid container support portion includes a support member that can be engaged with the end portion, and the liquid container is supported by means of the support member by the support portion of the casing.

With this configuration, the liquid container is supported, at the end portion thereof on the side where the liquid outlet portion is formed, by the support portion. Thus, the liquid outlet portion and the liquid inlet portion can be readily connected to each other.

Furthermore, since the liquid container is provided with the support member, the liquid container can be handled while holding the support member. Accordingly, the liquid container can be readily attached to and detached from the support portion.

It is preferable that, in this liquid supply apparatus, the liquid container is supported and hanged, at the end portion thereof on the side where the liquid outlet portion is formed, from the support portion.

With this configuration, the liquid container is hanged. Thus, liquid is collected under its own weight in the lower portion of the liquid container, and, thus, the flexible portion of the liquid container is tensioned. Accordingly, the flexible portion of the liquid container can become flattened straight with no crease or twist as liquid inside the liquid containing portion is consumed, and, thus, liquid can be stably supplied to the liquid-jet device.

Furthermore, if liquid-jet device is a device in which the carriage carrying the liquid-jet head travels, vibration of the liquid-jet device is transmitted to the liquid container, and the lower portion of the liquid container swings. Thus, if the liquid is ink that tends to form precipitates, such as pigment ink, the ink can be stirred by the swinging, and, thus, a difference in the concentration in the ink can be suppressed.

It is preferable that, in this liquid supply apparatus, the support member supports the liquid outlet portion.

With this configuration, the liquid outlet portion of the liquid container is supported by the support member. Thus, the liquid containing portion can become flattened straight with no crease or twist as liquid inside the liquid containing portion is consumed, and, thus, liquid can be stably supplied to the liquid-jet device.

It is preferable that, in this liquid supply apparatus, the support member supports the liquid containing portion on both sides of the liquid outlet portion.

With this configuration, the support member supports the liquid container on both sides of the liquid outlet portion of the liquid containing portion. Accordingly, the liquid containing portion can be stably supported in a well-balanced manner.

It is preferable that, in this liquid supply apparatus, the liquid container has a channel in communication with the liquid outlet portion and extending to a lower portion in the gravity direction of the liquid containing portion.

With this configuration, even when the liquid outlet portion is positioned at the upper portion, liquid can be drawn upward from the lower portion in the liquid containing portion through the channel, and, thus, the liquid can be stably supplied.

In order to solve the above-described problem, an aspect of the invention is directed to a liquid supply apparatus for supplying liquid to a liquid-jet device, including: a liquid container that has a liquid containing portion at least partially having a flexible portion, and a liquid outlet portion in communication with the liquid containing portion; a support portion that supports at least part of the liquid container; a liquid inlet portion that can be connected to the liquid outlet portion; a channel member that connects the liquid inlet portion and the liquid-jet device; and a casing that accommodates the liquid container and is provided with the support portion. The casing includes: a first peripheral wall facing the liquid-jet device; a second peripheral wall facing the first peripheral wall; a third peripheral wall and a fourth peripheral wall intersecting the first peripheral wall and the second peripheral wall; a bottom wall intersecting the first peripheral wall, the second peripheral wall, the third peripheral wall, and the fourth peripheral wall; an opening portion provided on the side facing the bottom wall; and a see-through portion through which a state of the flexible portion of the liquid containing portion displaced as the liquid inside the liquid container is consumed can be seen; and a distance between the first peripheral wall and the second peripheral wall of the casing is smaller than a width at an end portion of the liquid container on the side where the liquid outlet portion is formed.

With this configuration, the casing has the see-through portion. Thus, the state of the liquid container deformed in the casing can be seen from the outside of the casing. Accordingly, the degree of liquid consumed can be checked from the outside of the casing. Moreover, the distance between the first peripheral wall and the second peripheral wall of the casing is smaller than the width at the end portion of the liquid container on the side where the liquid outlet portion is formed. Thus, when viewed from the opening portion side toward the bottom wall, the end portion of the liquid container is disposed at an angle with respect to or parallel to the first peripheral wall and the second peripheral wall. Especially when a plurality of liquid containers are arranged at an angle, and, for example, the third peripheral wall is arranged as a front wall in line with the paper discharge port side (i.e., the front face side) of the liquid-jet device, and is provided with the see-through portion, the state of the plurality of liquid containers deformed can be seen through the front third wall. Thus, the degree of liquid in the liquid containers consumed can be checked therethrough.

Incidentally, the configuration in which no see-through portion is provided in the casing is problematic in that the state of the liquid container deformed in the casing cannot be seen from the outside of the casing, so that the degree of liquid in the liquid container consumed cannot be checked from the outside of the casing. Also, the configuration in which the distance between the first peripheral wall and the second peripheral wall of the casing is larger than the width at the end portion of the liquid container on the side where the liquid outlet portion is formed is problematic in that the size of the casing increases.

In order to solve the above-described problem, an aspect of the invention is directed to a liquid container for containing liquid that is to be used by a liquid-jet device, including: a liquid outlet portion through which the liquid flows to the outside; a liquid containing portion that has a flexible wall, and an end portion of which is provided with the liquid outlet portion; and a hanger member that can be engaged with the end portion at which the liquid outlet portion is provided.

With this configuration, the liquid container includes the hanger member that can be engaged with the end portion at which the liquid outlet portion is provided. Thus, the liquid container can be hanged such that the liquid outlet portion is positioned at the upper end portion in the gravity direction. As a result, liquid is collected under its own weight in the lower portion of the liquid container, and, thus, the flexible wall of the liquid containing portion is tensioned. Accordingly, the flexible wall of the liquid containing portion can become flattened straight with no crease or twist as liquid inside the liquid containing portion is consumed. Thus, when the liquid outlet portion is arranged in communication with the liquid-jet device, liquid can be stably supplied to the liquid-jet device.

Although it is difficult to handle a liquid container having a flexible wall, the liquid container according to an aspect of the invention can be readily handled because it can be held at the hanger member. Furthermore, since the flexible wall does not have to be held, damage to the flexible wall, which leads to liquid leakage, can be prevented.

It is preferable that, in this liquid container, the hanger member supports the liquid outlet portion.

With this configuration, the hanger member supports the liquid outlet portion. Thus, when the liquid outlet portion is arranged in communication with the liquid-jet device, the connection can be readily established.

It is preferable that, in this liquid container, the hanger member supports the liquid containing portion on both sides of the liquid outlet portion.

With this configuration, the end portion of the liquid containing portion that is engaged with the hanger member is supported on both sides of the liquid outlet portion. Thus, the end portion is supported so as to extend straight, and, thus, the liquid can stably flow to the outside.

It is preferable that this liquid container further includes a channel in communication with the liquid outlet portion and extending to the side opposite from the end portion of the liquid containing portion.

With this configuration, when the liquid container is hanged from the hanger member, liquid can be drawn upward from the bottom portion of the liquid containing portion to the liquid outlet portion, and, thus, the liquid can stably flow to the outside.

BRIEF DESCRIPTION OF THE DRAWINGS

The invention will be described with reference to the accompanying drawings, wherein like numbers reference like elements.

DESCRIPTION OF EXEMPLARY EMBODIMENT

Hereinafter, an embodiment of an image forming system will be described with reference to the drawings.

Figure 1:
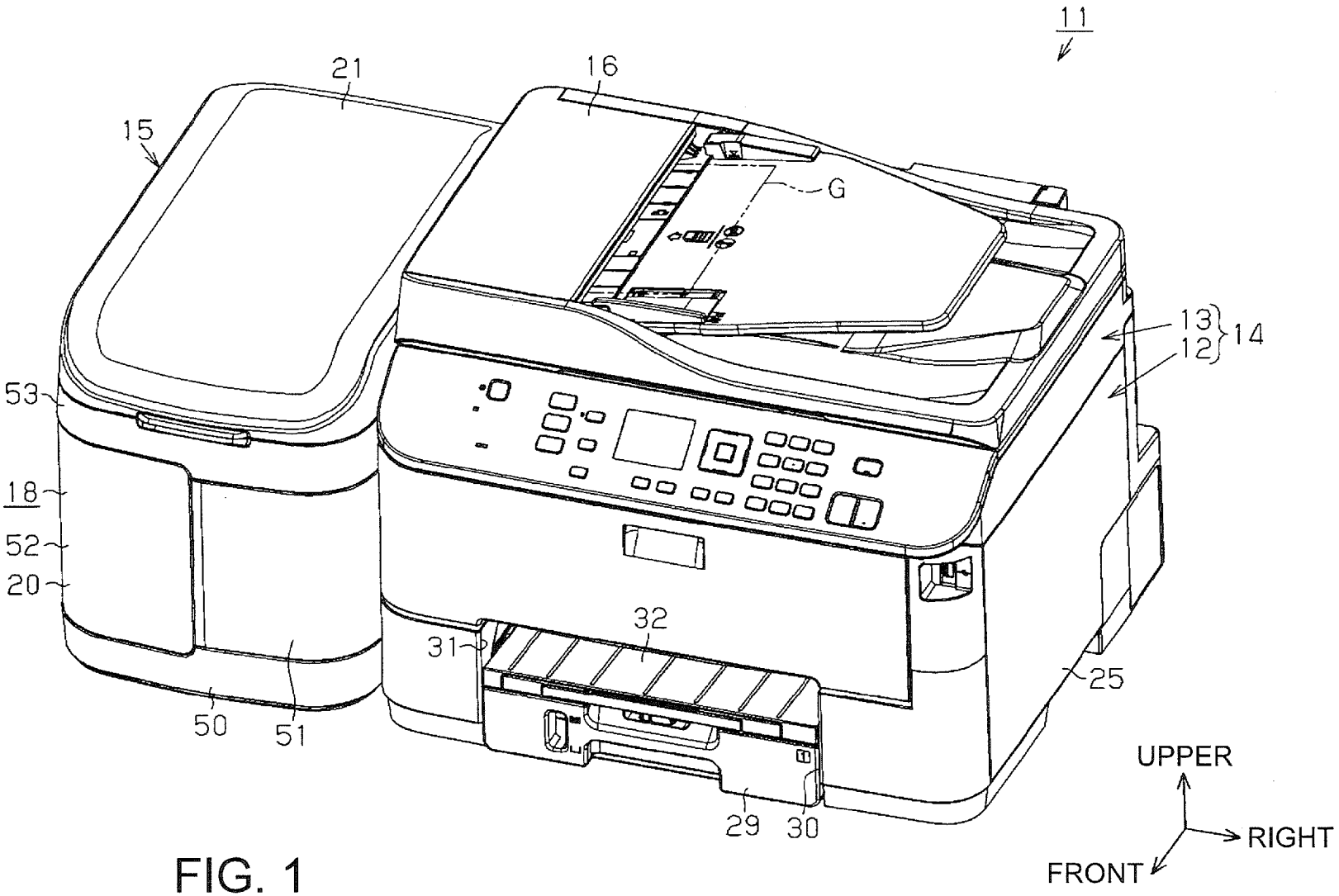
FIG. 1 is a perspective view of an image forming system according to an embodiment.
Figure 2:
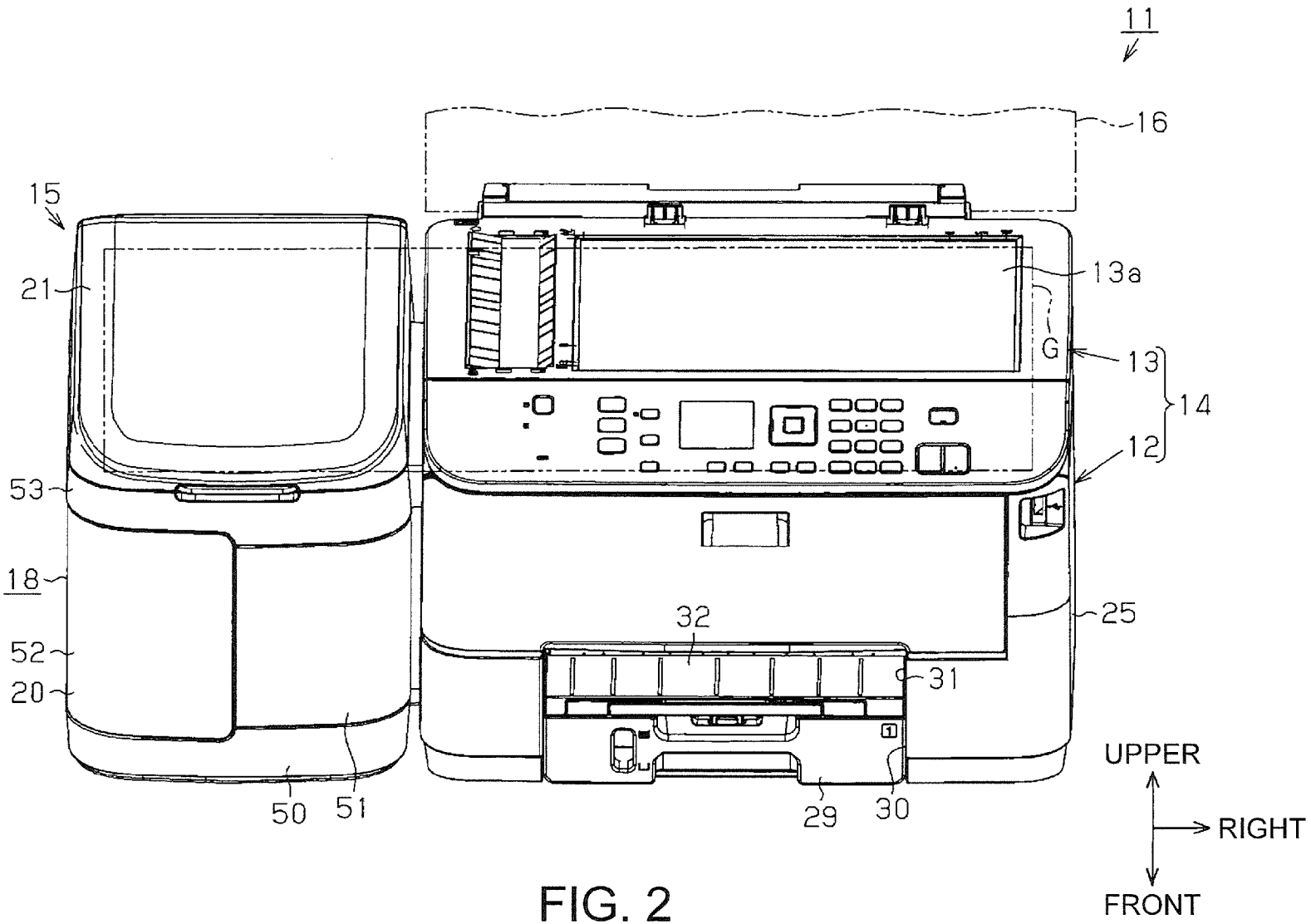
FIG. 2 is a perspective view of the image forming system when its automatic document feeder is open.

As shown in FIGS. 1 and 2, an image forming system 11 includes an image forming apparatus 14 having an inkjet printer 12 as an exemplary liquid-jet device for jetting ink (liquid) and a reading device 13 for reading a document G (medium), and an ink supply apparatus 15 as an exemplary liquid supply apparatus for supplying ink to the inkjet printer 12. The reading device 13 is disposed on the inkjet printer 12.

An upper end portion of the reading device 13 has a reading face 13*a* for reading the document G. An automatic document feeder 16 that can swing to expose and cover the reading face 13*a* is disposed on the reading device 13. The automatic document feeder 16 reverses sheet by sheet a plurality of stacked documents G and sequentially feeds the documents onto the reading face 13*a*.

Figure 3:
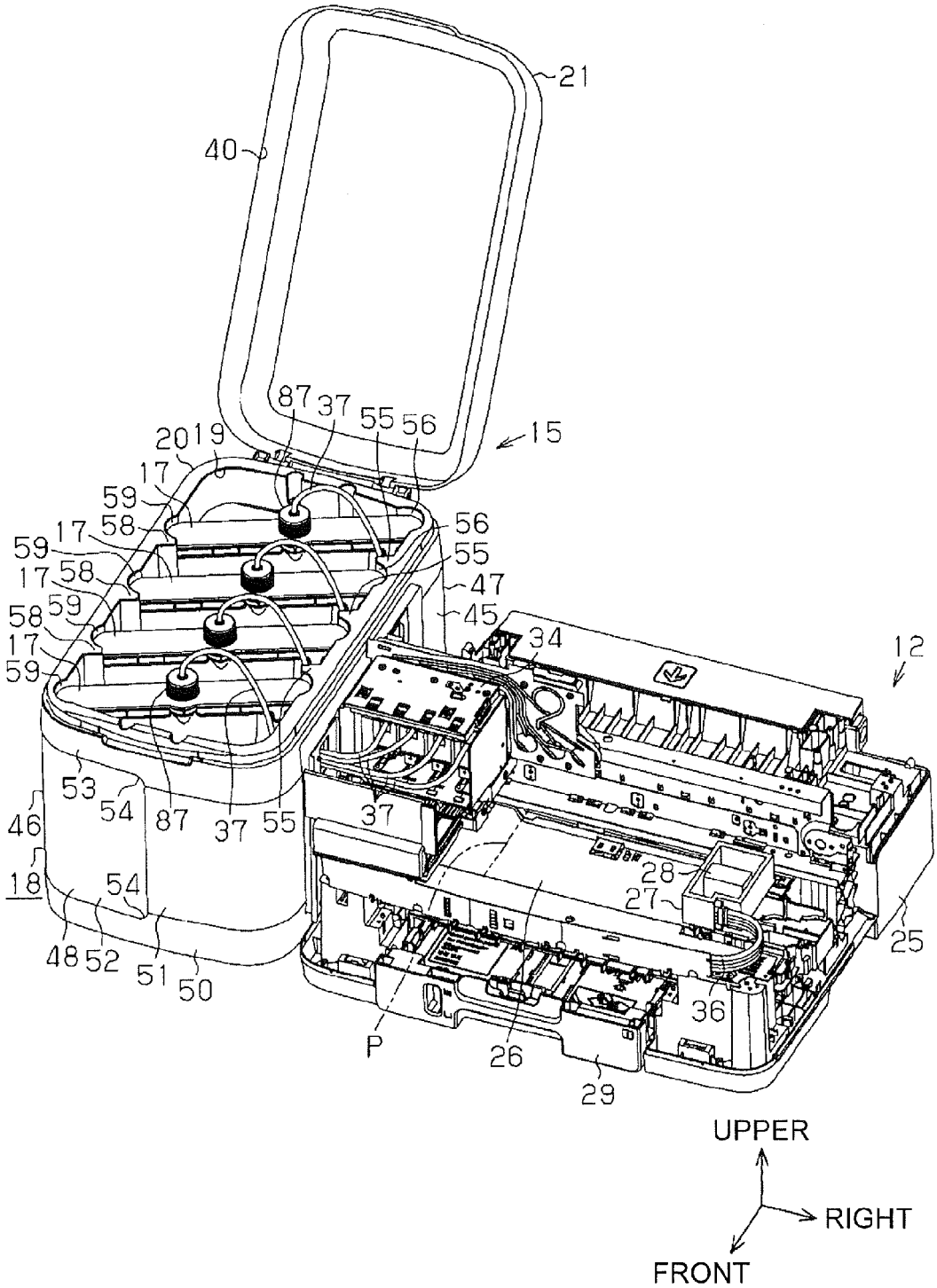
FIG. 3 is a perspective view showing the inside of the image forming system.

As shown in FIGS. 2 and 3, the ink supply apparatus 15 is disposed on the left of the inkjet printer 12. That is to say, the ink supply apparatus 15 is disposed on the left side of the inkjet printer 12 (the image forming apparatus 14) such that the ink supply apparatus 15 and the inkjet printer 12 are arranged in line in the left-right direction.

The ink supply apparatus 15 includes a plurality of (four, in this embodiment) substantially rectangular ink containers 17 as exemplary liquid containers in which ink is contained, and a casing 18 as an exemplary liquid container accommodating container in which the ink containers 17 are accommodated. The casing 18 includes a container main body 20 in the shape of a bottomed rectangular box elongated in the front-rear direction and having an upper end formed as an opening portion 19 through which the ink containers 17 are accommodated, and a lid member 21 that covers the opening portion 19 in an openable/closable manner. Both of the container main body 20 and the lid member 21 are made of a synthetic resin material.

In the container main body 20, four ink containers 17 are arranged in line in the front-rear direction. The four ink containers 17 respectively contain, sequentially from the rear to the front, cyan ink, magenta ink, yellow ink, and black ink. In this case, the ink container 17 containing black ink, which is most frequently used, is disposed on the frontmost side in the container main body 20.

The casing 18 is detachably attached to the left face of the inkjet printer 12 (the image forming apparatus 14) such that the upper face of the casing 18 when the lid member 21 is closed and the reading face 13*a* have equivalent heights. In this specification, "have equivalent heights" refers to not only having the same height but also a difference between the heights being within 2 cm. In this embodiment, the height of the casing 18 is lower than that of the reading face 13*a* by 5 mm.

As shown in FIGS. 1 and 3, the inkjet printer 12 includes a main body casing 25 substantially in the shape of a rectangular solid elongated in the left-right direction. The center in the main body casing 25 is provided with a support surface 26 for supporting a paper P as an exemplary target (described later). A carriage 27 that can travel back and forth in the left-right direction, which is the main-scanning direction, is provided above the support surface 26.

A recording head 28 as an exemplary liquid-jet head is supported inside the carriage 27 so as to be exposed from the lower face of the carriage 27. The recording head 28 faces the support surface 26. The recording head 28 performs printing on the paper P by jetting ink from a plurality of nozzles (not shown) onto the paper P that is being conveyed from the rear to the front on the support surface 26, while the carriage 27 is traveling in the left-right direction.

Furthermore, a paper cassette 29 in which a plurality of papers P can be stacked and accommodated is disposed below the support surface 26 in the main body casing 25. The paper cassette 29 is detachably mounted in the main body casing 25 through an opening portion 30 provided at a lower portion in the middle of the front face of the main body casing 25. A paper transport mechanism (not shown) reverses sheet by sheet the papers P in the paper cassette 29 and sequentially feeds the papers P from the rear side onto the support surface 26.

The papers P on which printing has been performed on the support surface 26 are sequentially discharged from a paper discharge port 31 formed in a region above the paper cassette 29 in the opening portion 30. Note that the region above the paper cassette 29 is provided with a paper discharge tray 32 so as to be extendable in the front-rear direction. The papers P sequentially discharged from the paper discharge port 31 are sequentially supported in the paper discharge tray 32.

Figure 4:
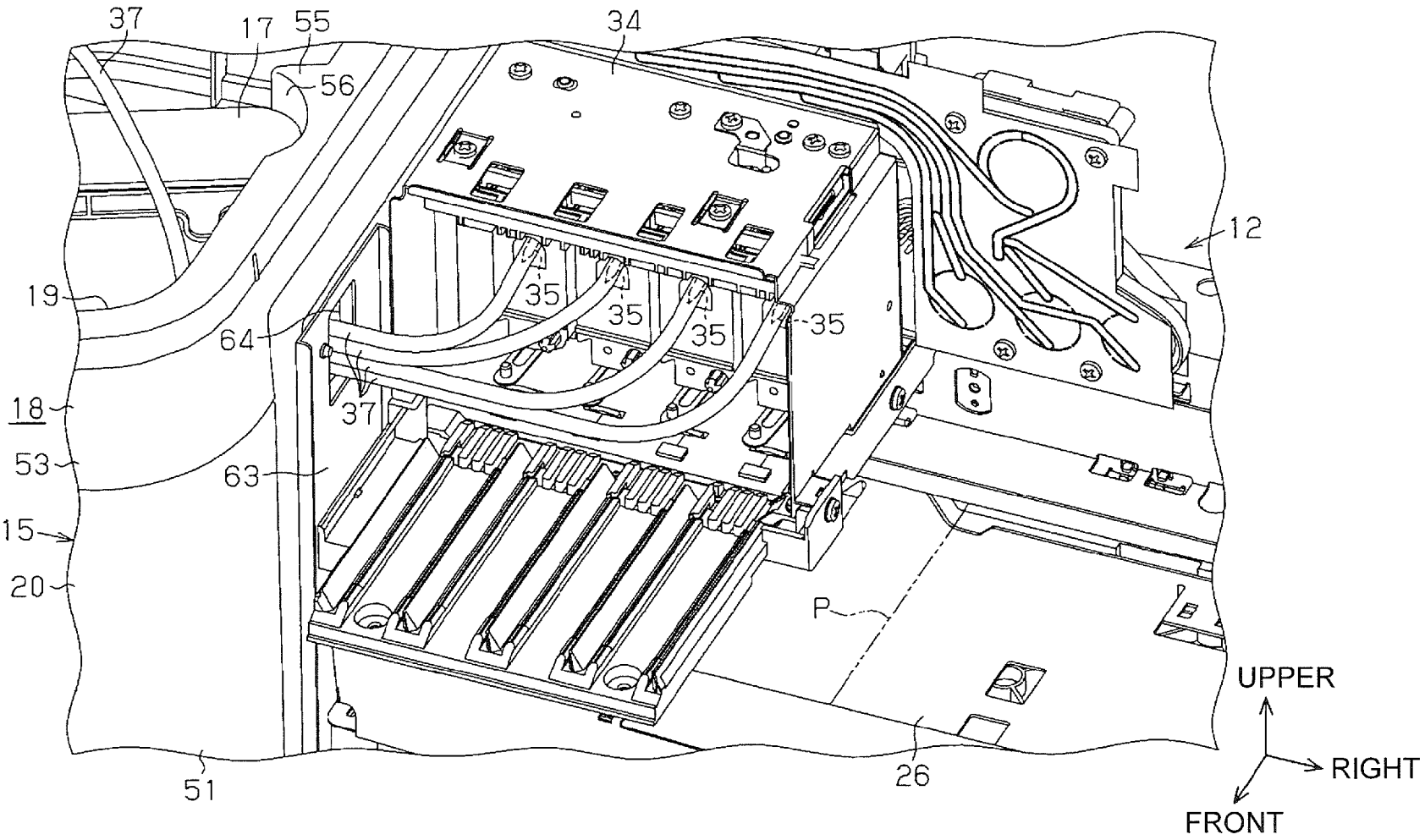
FIG. 4 is an enlarged view of the main portion in FIG. 3.

As shown in FIGS. 3 and 4, the left end in the main body casing 25 includes a holder casing 34 in the shape of a rectangular box having an opening on the front side, and a plurality of (four, in this embodiment) hollow ink supply needles 35 arranged in line in the left-right direction on the bottom wall (rear wall) of the holder casing 34.

Each of the ink supply needles 35 extends in the front-rear direction, and penetrates a peripheral wall of the holder casing 34. The rear end of the ink supply needle 35 is connected to one of the ends of a flexible ink supply tube 36, and the other end of the ink supply tube 36 is connected to the recording head 28. The inkjet printer 12 of this embodiment is configured such that cyan ink, magenta ink, yellow ink, and black ink in this order from the left to the right are respectively supplied to the four ink supply needles 35.

Based on the ink colors, the order in which the ink supply needles 35 are arranged from the left to the right in the holder casing 34 matches the order in which the ink containers 17 are arranged from the rear to the front in the container main body 20. Furthermore, the ink containers 17 and the ink supply needles 35 are connected to each other such that ink of the corresponding color is supplied via flexible connection tubes 37 as exemplary channel members forming part of the ink supply apparatus 15.

Accordingly, ink supplied from the ink containers 17 of the ink supply apparatus 15 through the connection tubes 37 to the ink supply needles 35 is further supplied through the ink supply tubes 36 to the recording head 28.

Next, the configuration of the casing 18 will be described in detail.

As shown in FIGS. 2 and 3, the lid member 21 of the casing 18 is in the shape of a covered rectangular box having an opening portion 40 facing the container main body 20, elongated in the front-rear direction, and having a height lower than that of the container main body 20. The lid member 21 is linked via a hinge portion 41 to the upper end of the rear face of the container main body 20. Accordingly, when opening and closing the lid member 21, the lid member 21 swings about the hinge portion 41. That is to say, the lid member 21 is opened from the front side of the container main body 20, and is closed to the front side of the container main body 20. Note that, when the lid member 21 is closed on the opening portion 19 of the container main body 20, the opening portion 40 conforms to the opening portion 19.

Figure 5:
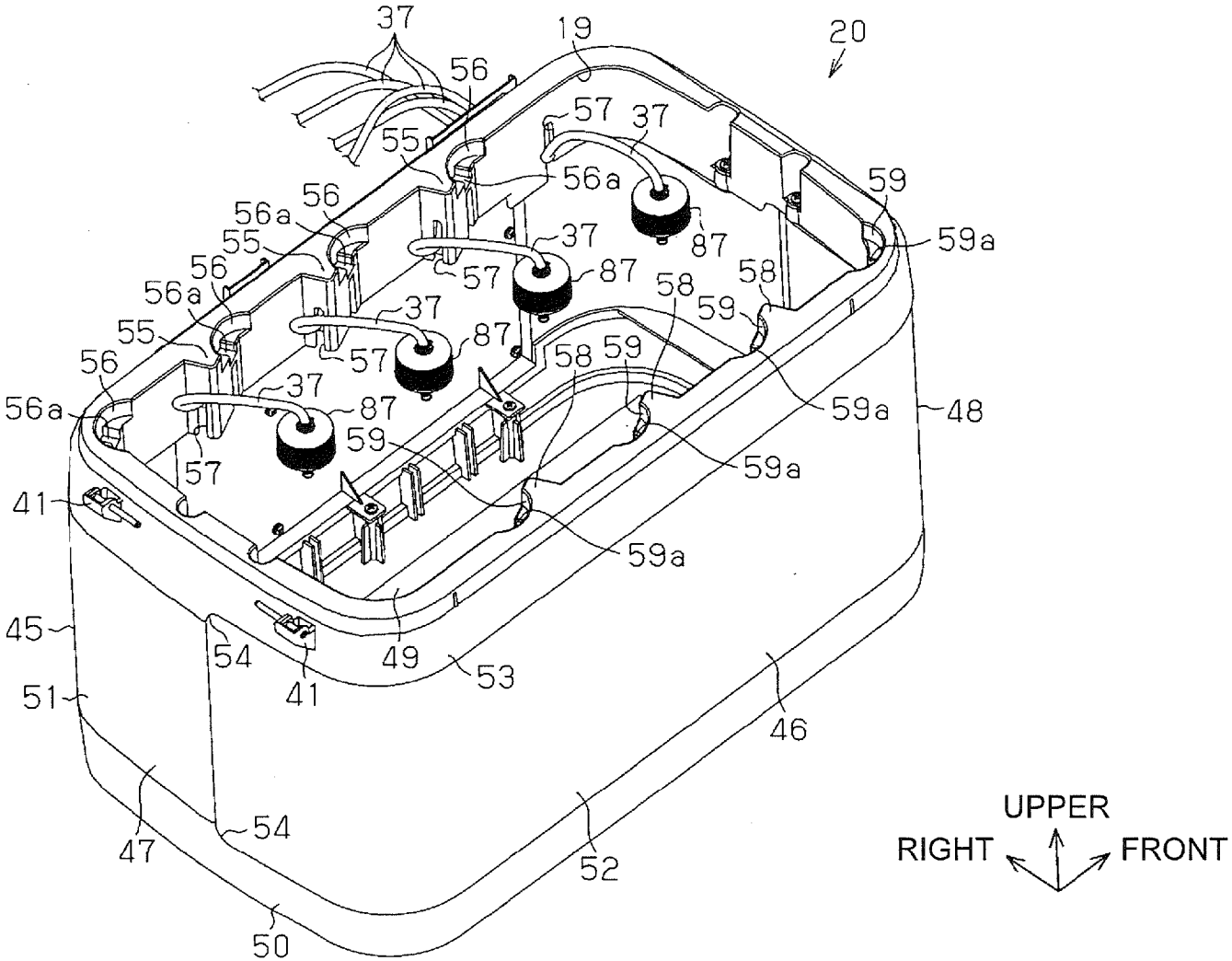
FIG. 5 is a perspective view of a container main body of a casing of an ink supply apparatus in the image forming system.

As shown in FIGS. 3 and 5, the container main body 20 in the shape of a bottomed rectangular box includes a right peripheral wall 45 facing the inkjet printer 12, a left peripheral wall 46 facing the right peripheral wall 45, a rear peripheral wall 47 and a front peripheral wall 48 orthogonal to the right peripheral wall 45 and the left peripheral wall 46, and a bottom wall 49 orthogonal to the right peripheral wall 45, the left peripheral wall 46, the rear peripheral wall 47, and the front peripheral wall 48.

The opening portion 19 is provided on the side facing the bottom wall 49. That is to say, the opening portion 19 faces the bottom wall 49, and is formed above the bottom wall 49 in the gravity direction. In this embodiment, the right peripheral wall 45, the left peripheral wall 46, the rear peripheral wall 47, and the front peripheral wall 48 respectively form a first peripheral wall, a second peripheral wall, a third peripheral wall, and a fourth peripheral wall. Furthermore, the distance between the right peripheral wall 45 and the left peripheral wall 46 in the container main body 20 is smaller than the width at the upper end portion (one of the end portions) of the ink containers 17.

The container main body 20 includes a bottom wall forming member 50 in the shape of a bottomed rectangular box forming the bottom wall 49, a right peripheral wall forming member 51 in the shape of a plate forming the right half of the peripheral wall and curved substantially in the shape of a U, a left peripheral wall forming member 52 in the shape of a plate forming the left half of the peripheral wall and curved substantially in the shape of a U, and an edge member 53 in the shape of a hollow rectangular frame forming the peripheral edge of the opening portion 19 and having an opening on the lower side.

The container main body 20 is formed by combining the right peripheral wall forming member 51 as an exemplary separate member and the left peripheral wall forming member 52 as an exemplary separate member. That is to say, the peripheral wall of the container main body 20 is formed by combining the right peripheral wall forming member 51 and the left peripheral wall forming member 52, which are two separate members separated into left and right members.

The width in the vertical direction of the left peripheral wall forming member 52 is slightly larger than that of the right peripheral wall forming member 51. Accordingly, positions in the lower end of the edge member 53 and the upper end of the bottom wall forming member 50 corresponding to the contact portions of the left peripheral wall forming member 52 and the right peripheral wall forming member 51 are respectively provided with steps 54.

Furthermore, the left peripheral wall forming member 52 is made of a transparent synthetic resin material. Accordingly, the ink containers 17 accommodated inside the container main body 20 can be seen from the outside of the container main body 20 through the left peripheral wall forming member 52. Note that, in this embodiment, the left peripheral wall forming member 52 forms a see-through portion.

As shown in FIGS. 3 and 5, on the right internal face of the edge member 53, right projecting portions 55 that project inward (leftward) are formed in accordance with the number of ink containers 17. Note that, in this embodiment, there are four colors of ink and the ink container 17 disposed on the rearmost side does not require the right projecting portion 55, and, thus, three right projecting portions 55 are formed. The right projecting portions 55 are arranged at equal intervals in the front-rear direction. The right projecting portions 55 are each substantially in the shape of a covered triangular box having an opening on the lower side, which is the shape that conforms to the shape of each of tongue portions 70 to 72 (described later). In this case, each of the right projecting portions 55 is substantially triangular when viewed from above, and two sides of the projecting triangle are such that the rear side is shorter than the front side.

The upper face of the edge member 53 is provided with right recess portions 56 respectively at overlapping positions on the front sides of the right projecting portions 55 and the right rear corner. The right recess portions 56 are exemplary support portions for supporting the ink containers 17 at support members 92 (described later). The four right recess portions 56 are arranged at equal intervals in the front-rear direction, and each have the shape that conforms to the shape of part of the support member 92. A cut-out recess portion **56*a* is formed at the center on the bottom face of each of the right recess portions 56**.

Furthermore, the rear faces of the right projecting portions 55 and a portion near the right front corner on the right internal face of the edge member 53 are respectively provided with cut-out portions 57 as exemplary through portions extending from the lower end to above. The connection tubes 37 on the ink containers 17 side can be respectively inserted through the four cut-out portions 57. Note that the cut-out portions 57 are arranged at equal intervals in the front-rear direction.

On the left internal face of the edge member 53, left projecting portions 58 that project inward (rightward) are formed in accordance with the number of ink containers 17. Note that, in this embodiment, there are four colors of ink and the ink container 17 disposed on the frontmost side does not require the left projecting portion 58, and, thus, three left projecting portions 58 are formed. The left projecting portions 58 are formed at positions slightly shifted forward in the front-rear direction with respect to the right projecting portions 55. The left projecting portions 58 are arranged at equal intervals in the front-rear direction. The left projecting portions 58 are each substantially in the shape of a covered triangular box having an opening on the lower side. In this case, each of the left projecting portions 58 is substantially triangular when viewed from above, and two sides of the projecting triangle are such that the rear side is longer than the front side.

The upper face of the edge member 53 is provided with left recess portions 59 respectively at overlapping positions on the rear sides of the left projecting portions 58 and the left front corner. The left recess portions 59 are exemplary support portions for supporting the ink containers 17 at the support members 92 (described later). The four left recess portions 59 are arranged at equal intervals in the front-rear direction, and each have the shape that conforms to the shape of part of the support member 92. A cut-out recess portion **59*a* is formed at the center on the bottom face of each of the left recess portions 59. The left recess portions 59 respectively face the right recess portions 56** in a direction that intersects the left-right direction at an angle of smaller than 90 degrees (30 degrees, in this embodiment).

Figure 6:
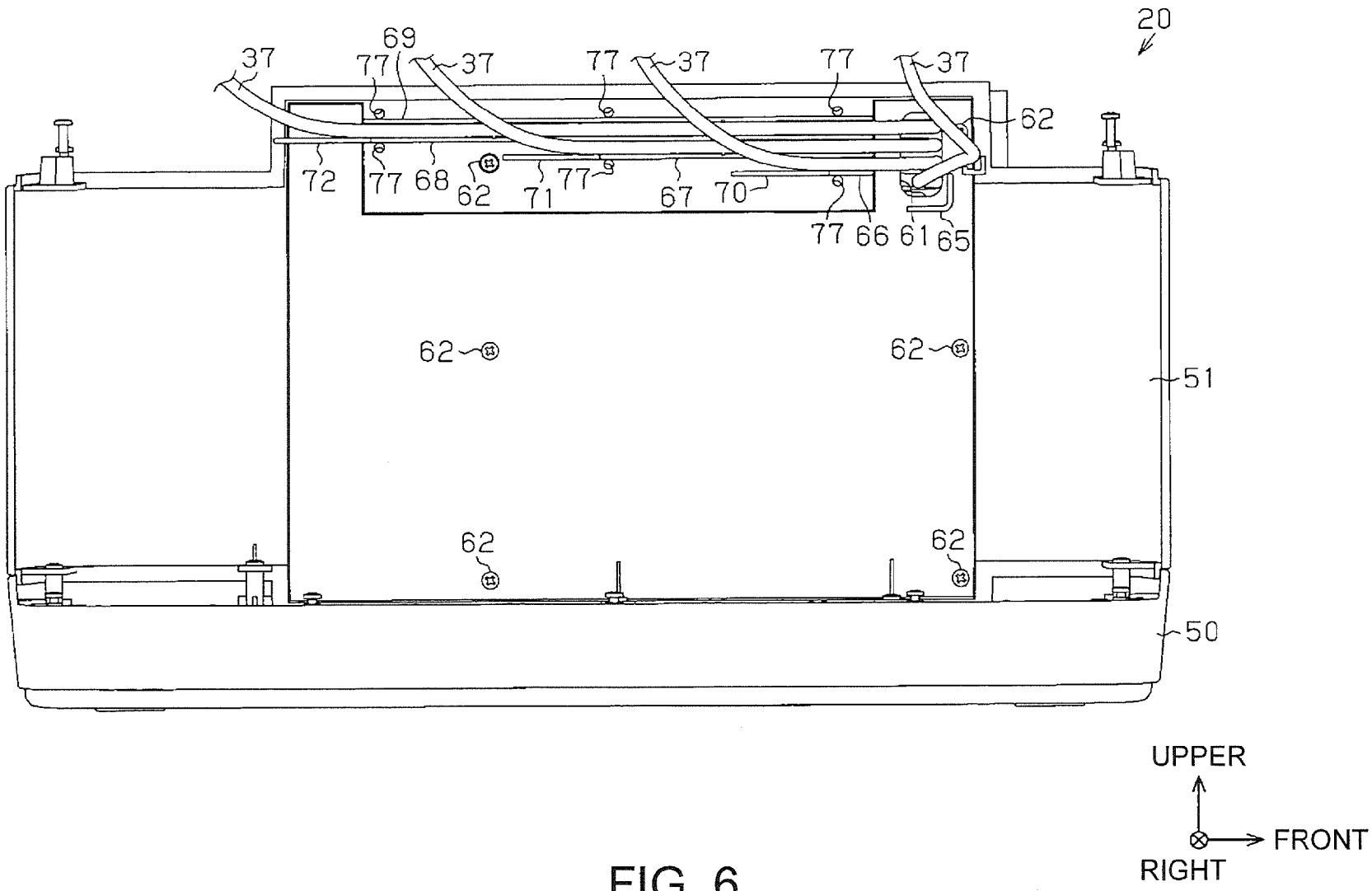
FIG. 6 is a side view of the inside of the container main body viewed from the left.
Figure 7:
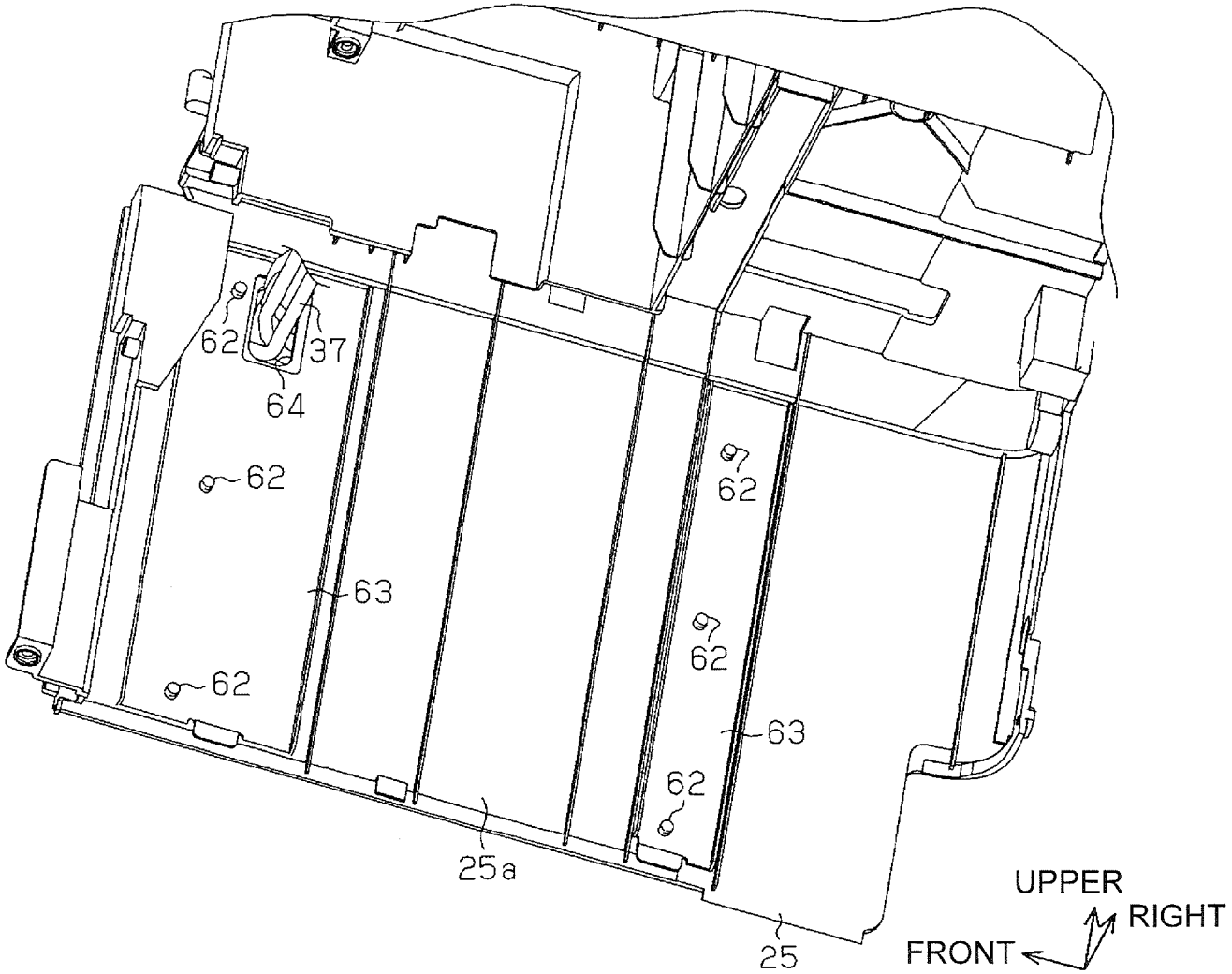
FIG. 7 is a perspective view of the inside of a main body casing of an inkjet printer in the image forming system viewed from the right.

As shown in FIGS. 6 and 7, a container-side through hole 61 as an exemplary insertion portion into which the connection tubes 37 can be inserted is formed at a position near the front side in the upper end on the internal face of the right peripheral wall forming member 51. The right peripheral wall forming member 51 is attached by a plurality of (six, in this embodiment) screws 62 from the inside of the container main body 20 to a left peripheral wall **25*a* of the main body casing 25**.

Figure 8:
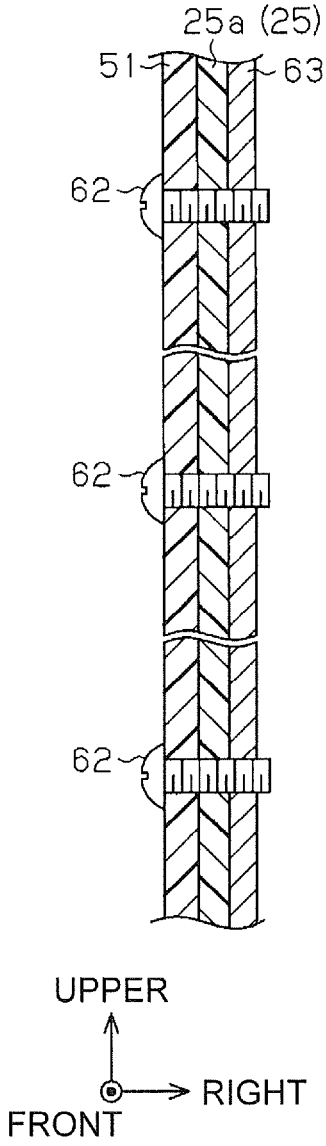
FIG. 8 is a cross-sectional schematic view showing the portion connecting the ink supply apparatus and the inkjet printer in the image forming system.

In this case, as shown in FIGS. 7 and 8, the right peripheral wall forming member 51 is attached to the left peripheral wall **25*a* of the main body casing 25 by inserting the six screws 62 to join the right peripheral wall forming member 51, the left peripheral wall 25*a*, and two rectangular metal plate members 63 that are arranged spaced away from each other in the front-rear direction on the internal side of the left peripheral wall 25*a***.

Figure 9:
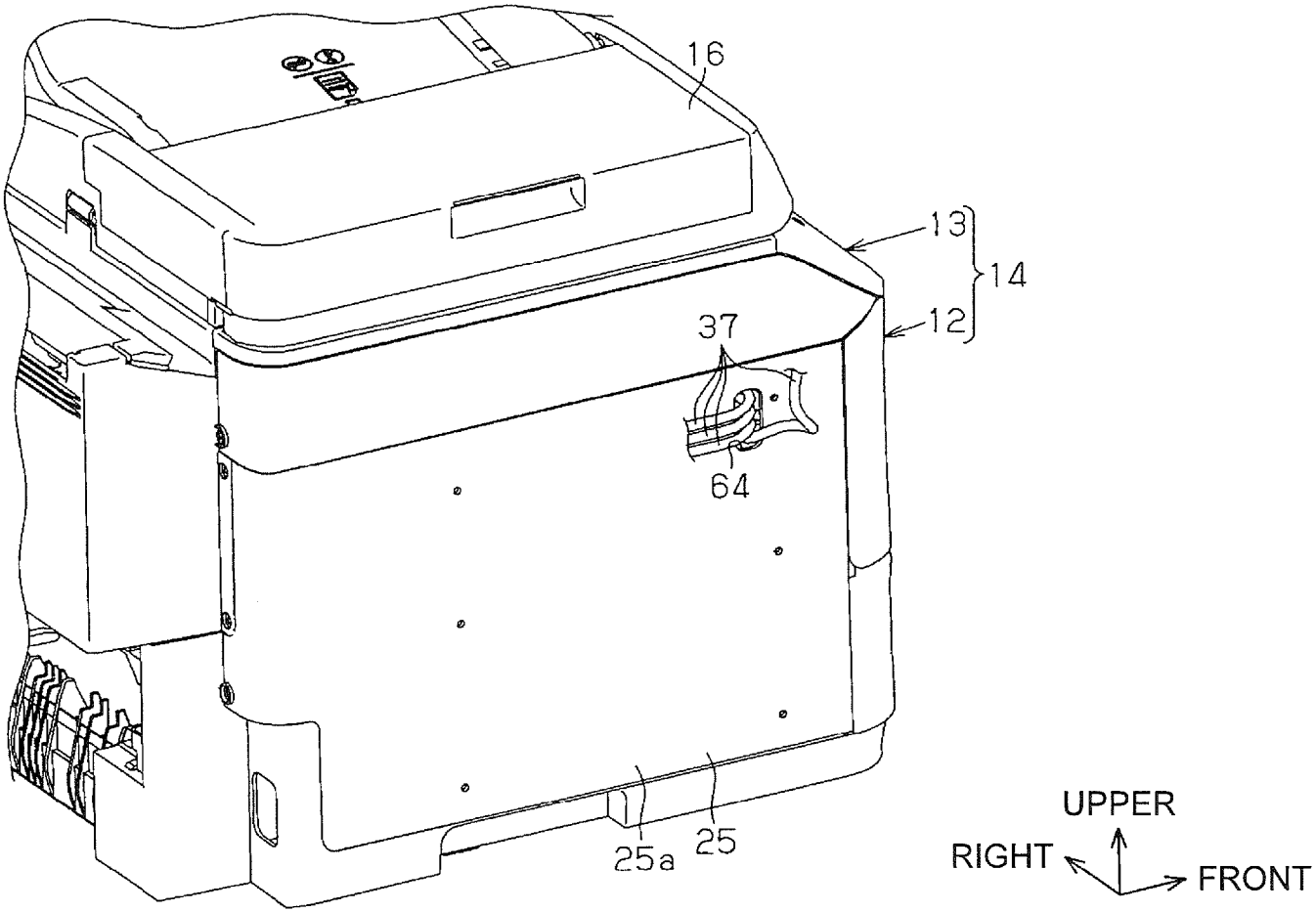
FIG. 9 is a perspective view of the image forming apparatus in the image forming system viewed from the left.

As shown in FIG. 9, a main body casing-side through hole 64 through which the connection tubes 37 are inserted is formed through the left peripheral wall 25*a* of the main body casing 25, at a position corresponding to the container-side through hole 61. As shown in FIGS. 4 and 6, the connection tubes 37 whose downstream ends are connected to the ink supply needles 35 are inserted through the main body casing-side through hole 64 and the container-side through hole 61, and the upstream ends of the connection tubes 37 are arranged inside the container main body 20.

Figure 10:
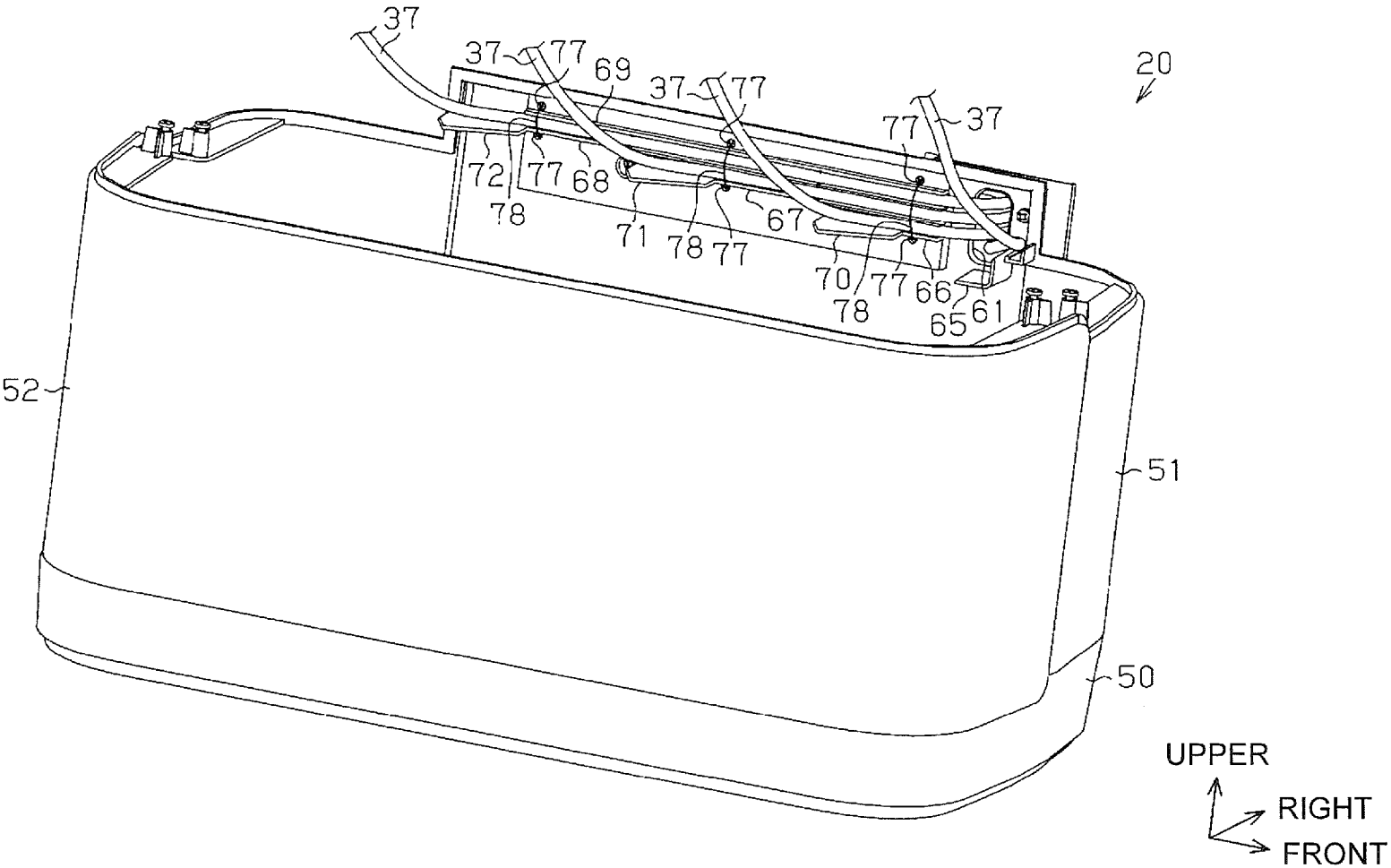
FIG. 10 is a perspective view of the container main body viewed from the left.
Figure 11:
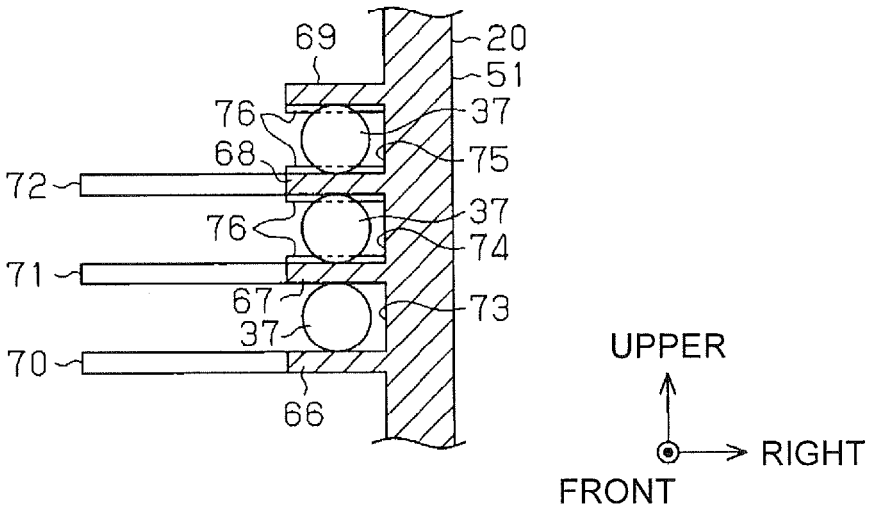
FIG. 11 is an enlarged cross-sectional view of the main portion in FIG. 10.

As shown in FIGS. 10 and 11, a first tube support portion 65 in the shape of an L-shaped plate for supporting one connection tube corresponding to black ink from among the connection tubes 37 inserted through the container-side through hole 61 is provided on the internal face of the right peripheral wall forming member 51, adjacent to the container-side through hole 61, at a position from the lower side to the front side of the container-side through hole 61. Furthermore, four ribs in the shape of plates extending in the front-rear direction parallel to each other project leftward in the horizontal direction at equal intervals in the vertical direction on the rear side of the container-side through hole 61 in the upper end on the internal face of the right peripheral wall forming member 51.

The four ribs have front ends that are aligned with each other, and will be referred to sequentially from below to above as a first rib 66, a second rib 67, a third rib 68, and a fourth rib 69. The first rib 66 has a length in the front-rear direction smaller than that of the second rib 67. The second rib 67 has a length in the front-rear direction smaller than that of the third rib 68. The third rib 68 and the fourth rib 69 have the same length in the front-rear direction.

A first tongue portion 70, a second tongue portion 71, and a third tongue portion 72 as exemplary support portions in the shape of plates that considerably project inward (leftward) in the horizontal direction from the first rib 66, the second rib 67, and the third rib 68 are respectively formed unitarily with the rear ends of the ribs 66 to 68. The first to the third tongue portions 70 to 72 suppress sagging of the connection tubes 37 by supporting the end portions of the connection tubes 37 on the ink containers 17 side. The tongue portions 70 to 72 are arranged at equal intervals in the front-rear direction, and the width in the left-right direction increases toward the rear side. In this case, the tongue portions 70 to 72 are arranged corresponding to the right projecting portions 55 of the edge member 53 (see FIG. 5). The tongue portions 70 to 72 are covered by the right projecting portions 55.

A groove formed between the first rib 66 and the second rib 67 functions as a second tube support portion 73 for supporting one connection tube corresponding to yellow ink from among the connection tubes 37. A groove formed between the second rib 67 and the third rib 68 functions as a third tube support portion 74 for supporting one connection tube corresponding to magenta ink from among the connection tubes 37. A groove formed between the third rib 68 and the fourth rib 69 functions as a fourth tube support portion 75 for supporting one connection tube corresponding to cyan ink from among the connection tubes 37.

Accordingly, as shown in FIGS. 3, 10, and 11, the first to the fourth tube support portions 65 and 73 to 75 guide the connection tubes 37 between the container-side through hole 61 and the ink containers 17 accommodated inside the container main body 20. That is to say, the connection tubes 37 guided by the first to the fourth tube support portions 65 and 73 to 75 extend through the container-side through hole 61 to the outside of the container main body 20. Note that, in this embodiment, the first to the fourth tube support portions 65 and 73 to 75 form guide portions.

Furthermore, the first to the fourth tube support portions 65 and 73 to 75 have lengths that vary in accordance with the distance to the container-side through hole 61 from the ink container 17 connected to the connection tube 37 guided by each tube support portion. That is to say, the lengths of the first to the fourth tube support portions 65 and 73 to 75 are such that the fourth tube support portion 75 is the longest, the third tube support portion 74 is the second longest, the second tube support portion 73 is the third longest, and the first tube support portion 65 is the shortest.

A pair of upper and lower protrusions 76 are provided at a partial portion in the length direction of the third tube support portion 74. The protrusions 76 are exemplary detachment suppressing portions for suppressing detachment, from the third tube support portion 74, of the connection tube 37 arranged in and supported by the third tube support portion 74.

A pair of upper and lower protrusions 76 are provided at a partial portion in the length direction of the fourth tube support portion 75. The protrusions 76 are for suppressing detachment, from the fourth tube support portion 75, of the connection tube 37 arranged in and supported by the fourth tube support portion 75. The protrusions 76 slightly cut into the connection tubes 37 arranged in the third tube support portion 74 and the fourth tube support portion 75. Each of the protrusions 76 is formed substantially in the shape of a rectangular solid, having the same width in the inner direction (left-right direction) as that of each of the ribs 66 to 69.

A pair of penetration holes 77 are formed between the first tongue portion 70 and the container-side through hole 61 in the front-rear direction in the upper end on the internal face of the right peripheral wall forming member 51. The penetration holes 77 are exemplary additional portions that are arranged on both sides of the first to the fourth ribs 66 to 69 in the vertical direction. A pair of penetration holes 77 are formed between the first tongue portion 70 and the second tongue portion 71 in the front-rear direction in the upper end on the internal face of the right peripheral wall forming member 51. The penetration holes 77 are arranged on both sides of the second to the fourth ribs 67 to 69.

A pair of penetration holes 77 are formed between the second tongue portion 71 and the third tongue portion 72 in the front-rear direction in the upper end on the internal face of the right peripheral wall forming member 51. The penetration holes 77 are arranged on both sides of the third rib 68 and the fourth rib 69 in the vertical direction. In a state where the connection tubes 37 are arranged in the second to the fourth tube support portions 73 to 75, wires 78 are respectively inserted into the pairs of penetration holes 77, and the ends of each wire 78 are connected to each other to form a ring, and, thus, the connection tubes 37 are reliably held respectively in the second to the fourth tube support portions 73 to 75. Accordingly, the penetration holes 77 are additionally provided in order to use the wires 78 to hold the connection tubes 37 when they are detached from the second to the fourth tube support portions 73 to 75.

As shown in FIGS. 5, 10, and 11, the first to the fourth ribs 66 to 69 (the second to the fourth tube support portions 73 to 75), the first to the third tongue portions 70 to 72, the first tube support portion 65, and the container-side through hole 61 are covered by the edge member 53. The connection tubes 37 respectively supported by the first to the fourth tube support portions 65 and 73 to 75 are respectively inserted through the four cut-out portions 57. The upstream ends of the connection tubes 37 are arranged through the cut-out portions 57 into the container main body 20.

Figure 12:
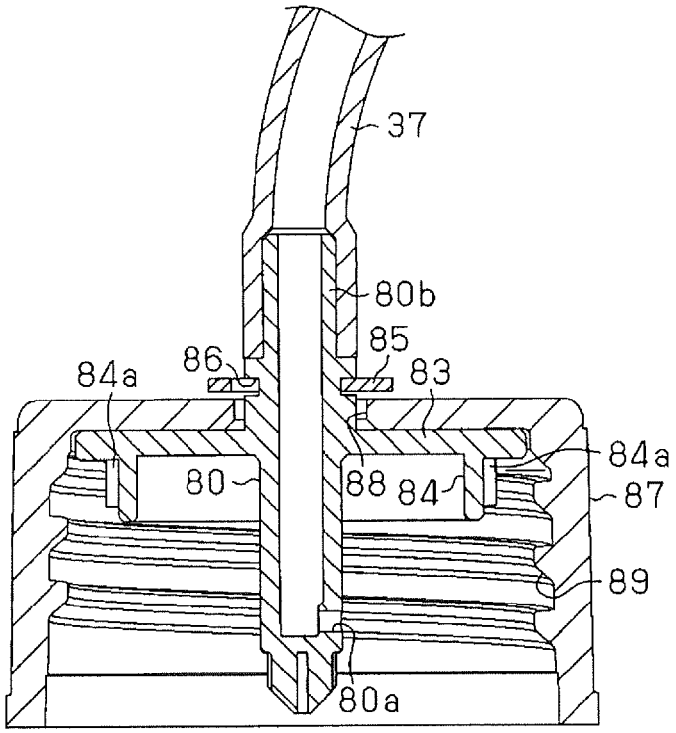
FIG. 12 is a cross-sectional view showing the state in which a cap of an ink inlet needle and a connection tube are connected to each other.
Figure 13:
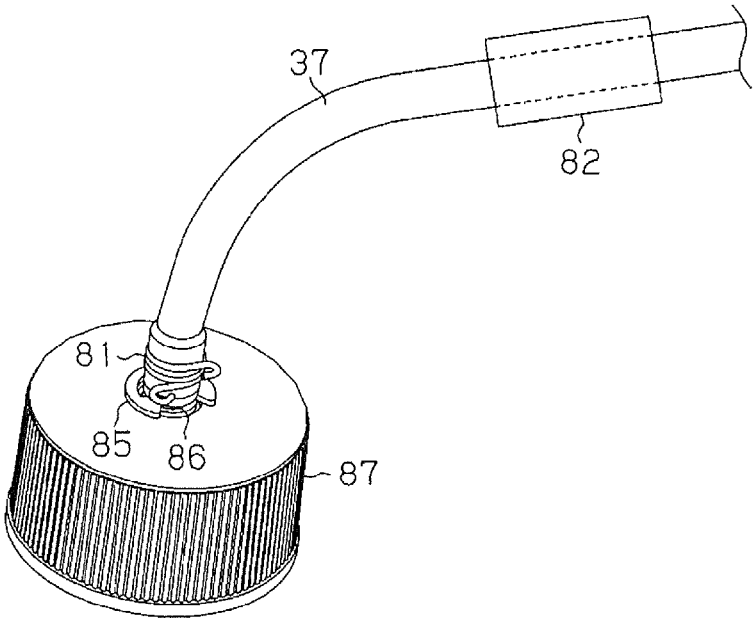
FIG. 13 is a perspective view of FIG. 12.

As shown in FIGS. 12 and 13, the upstream end of each of the connection tubes 37 is connected to a base end portion 80*b* of a hollow ink inlet needle 80. The ink inlet needle 80 has a tip portion provided with an inlet hole 80*a*, and is an exemplary liquid inlet portion. That is to say, the base end portion 80*b* of the ink inlet needle 80 is fitted to the upstream end of the connection tube 37. The portion of the connection tube 37 to which the base end portion 80*b* of the ink inlet needle 80 has been fitted is clamped by a torsion spring 81, in order to suppress detachment of the ink inlet needle 80 from the connection tube 37.

An ink flow adjusting member 82 is attached to the connection tube 37 at a position slightly downstream from the torsion spring 81. The ink flow adjusting member 82 can be switched between a mode in which the connection tube 37 is flattened so that the flow of the ink through the connection tube 37 is restricted, and a mode in which the connection tube 37 is not flattened so that the ink is allowed to flow through the connection tube 37.

Furthermore, the middle portion of the ink inlet needle 80 has a circular flange portion 83. A needle positioning portion 84 in the shape of a cylinder having a diameter slightly smaller than that of the flange portion 83 is provided on the face of the flange portion 83 on the inlet hole 80*a* side. A plurality of (four, in this embodiment) positioning protrusions 84*a* are provided at equal intervals in the circumferential direction on the outer circumferential face of the needle positioning portion 84.

The tips of the positioning protrusions 84*a* are positioned on the inner side with respect to the circumferential edge of the flange portion 83. An annular ring groove 86 to which an E-ring 85 can be fitted is formed on the outer circumferential face of the ink inlet needle 80 at a position slightly closer to the base end than the flange portion 83 is.

A cap 87 in the shape of a covered circular box having an opening on one of the sides is attached to the ink inlet needle 80. The cap 87 accommodates the portion of the ink inlet needle 80 from the flange portion 83 to the tip. That is to say, a cap through hole 88 through which the portion of the ink inlet needle 80 closer to the base end than the flange portion 83 is can be inserted from the inside of the cap 87 is formed at the center of the bottom wall of the cap 87. A thread groove 89 is formed on the inner circumferential face of the cap 87.

In a state where the portion of the ink inlet needle 80 closer to the base end than the flange portion 83 has been inserted from the inside of the cap 87 through the cap through hole 88 of the cap 87, the E-ring 85 is fitted to the ring groove 86 of the ink inlet needle 80, and, thus, the cap 87 is attached to the ink inlet needle 80. At that time, the bottom wall of the cap 87 is held with slight play between the flange portion 83 and the E-ring 85, and, thus, wobbling of the ink inlet needle 80 and the cap 87 is suppressed. At that time, the tip of the ink inlet needle 80 is accommodated inside the cap 87.

Next, the configuration of the ink container will be described in detail.

Figure 14:
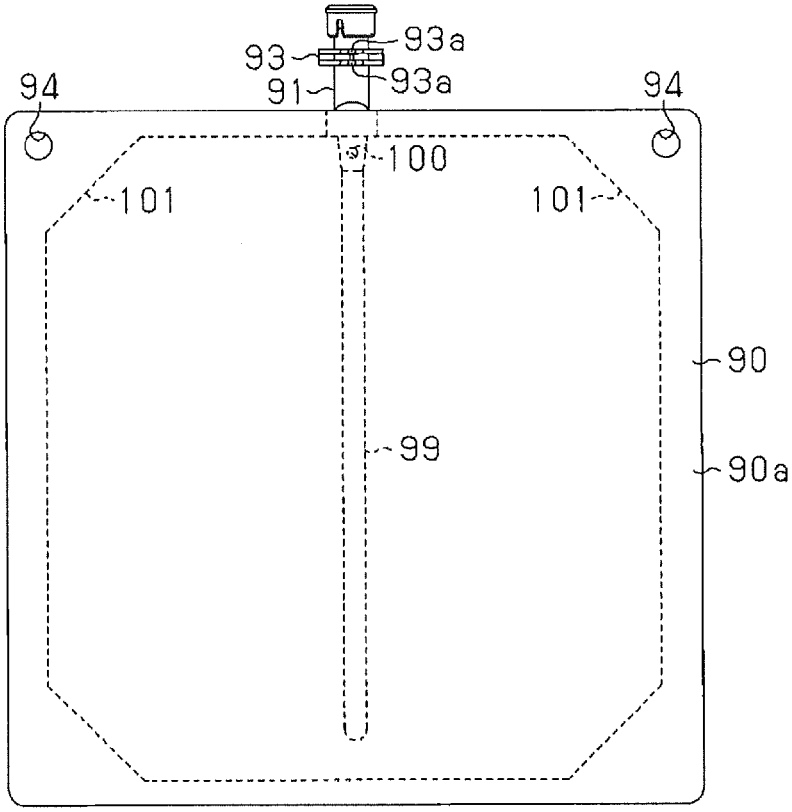
FIG. 14 is a side view of an ink bag on which an ink outlet portion is formed.
Figure 15:
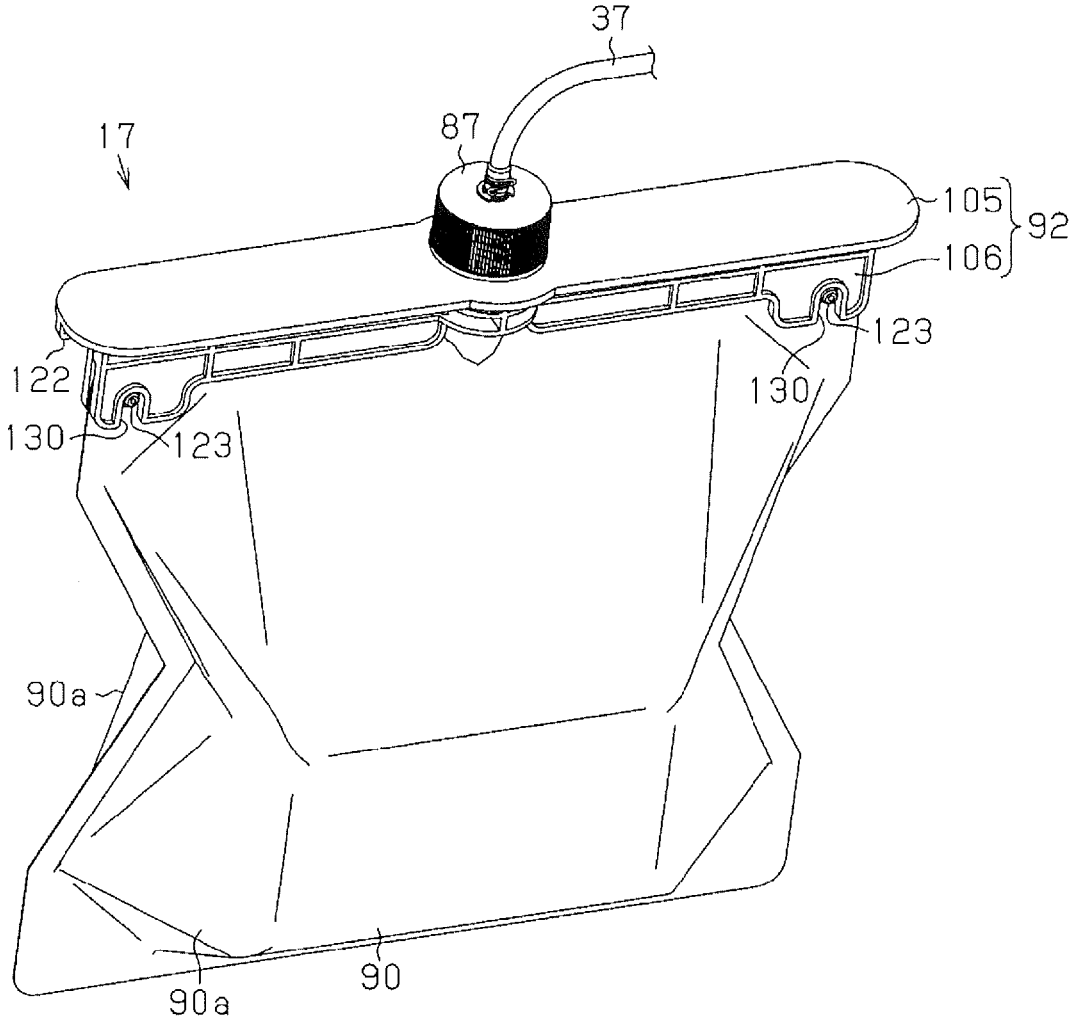
FIG. 15 is a perspective view of an ink container.

As shown in FIGS. 14 and 15, each of the ink containers 17 includes an ink bag 90 as an exemplary liquid containing portion for containing ink, and an ink outlet portion 91 as an exemplary liquid outlet portion that is formed at the upper end portion of the ink bag 90 in communication with the internal portion of the ink bag 90. The ink outlet portion 91 is positioned on the upper side in the gravity direction of the ink bag 90. Furthermore, a support member (hanger member) 92 is attached to the upper end portion (one of the end portions) of the ink bag 90 on which the ink outlet portion 91 is formed. The support member 92 forms a liquid container support portion that is supported by the container main body 20 (see FIG. 5). That is to say, the ink bag 90 is engaged with the support member 92.

The ink bag 90 is formed by placing peripheral edges of two rectangular flexible films 90*a* on both sides of the cylindrical ink outlet portion 91, and welding the peripheral edges of the two flexible films. That is to say, the ink bag 90 is a bag member configured by the flexible films 90*a* functioning as two flexible walls facing each other, and is formed such that the two facing flexible films 90*a* approach each other as ink contained inside is consumed. Note that, in this embodiment, a flexible portion is configured by the two flexible films 90*a* forming the ink bag 90.

The ink outlet portion 91 is disposed at the center in the width direction of the upper end portion of the ink bag 90. The upper end portion of the ink outlet portion 91 is exposed from the ink bag 90, and the lower end portion is disposed inside the ink bag 90. The portion of the ink outlet portion 91 exposed from the ink bag 90 and slightly below the upper end portion is provided with an outlet flange portion 93 substantially in the shape of a square having rounded corners.

Edge portions on both sides of the outlet flange portion 93 opposite from each other in the thickness direction of the ink bag 90 are provided with a pair of flange recess portions 93*a*. Both ends in the width direction of the welded portion of the upper end portion of the ink bag 90 in which no ink is contained are respectively provided with ink bag penetration holes 94.

Figure 18:
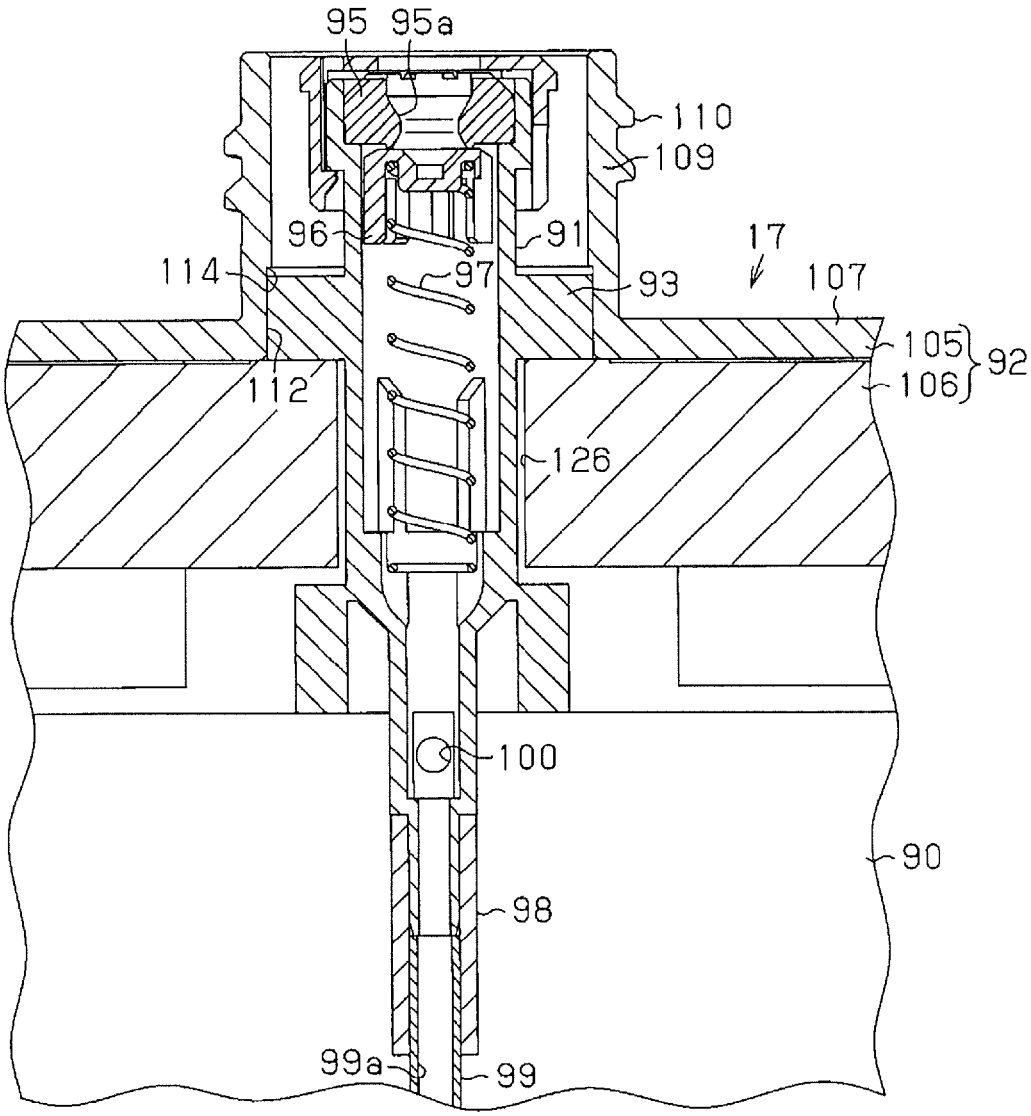
FIG. 18 is an enlarged cross-sectional view of the main portion of the ink container.
Figure 20:
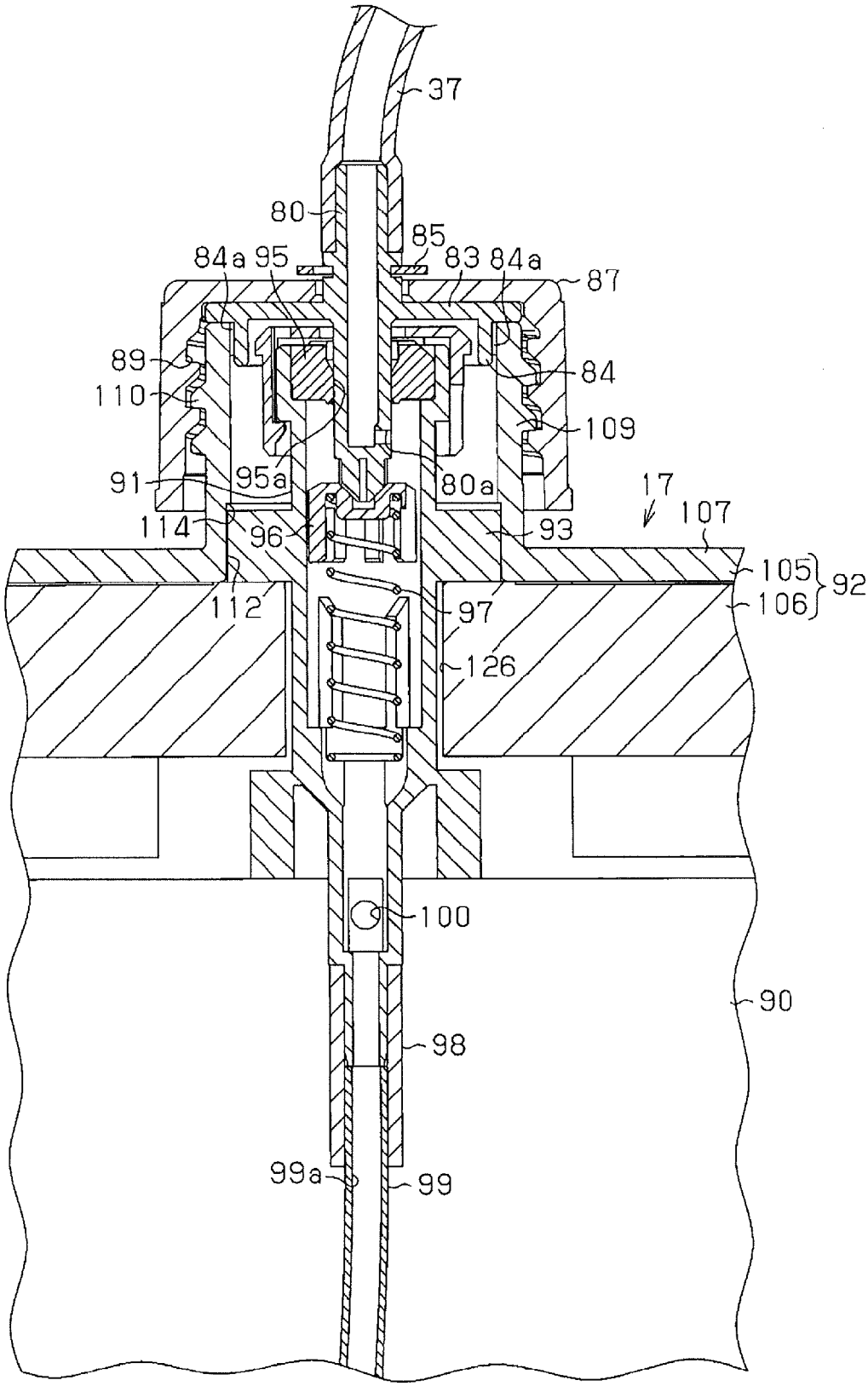
FIG. 20 is an enlarged cross-sectional view of the main portion showing the state in which the ink inlet needle is connected to the ink outlet portion of the ink container.

As shown in FIGS. 18 and 20, an annular gasket 95 forming an ink outlet port 95*a* from which ink flows out, a valve member 96 that is brought into contact with the gasket 95 so as to block the ink outlet port 95*a* from the inside, and a coil spring 97 for biasing the valve member 96 from the inside toward the gasket 95 are arranged inside the ink outlet portion 91. The lower end portion of the ink outlet portion 91 in the ink bag 90 is connected via a cylindrical flexible connection channel member 98 to the upper end (one of the ends) of an ink outlet tube 99 as an exemplary channel forming member forming a channel 99*a*. The connection channel member 98 is made of a material such as elastomer.

The lower end (the other end) of the ink outlet tube 99 extends to a lower portion in the ink bag 90. That is to say, the lower end of the ink outlet tube 99 extends in the ink bag 90 to the side opposite from the side where the ink outlet portion 91 is formed. Accordingly, the channel 99*a* in the ink outlet tube 99 extends to the lower portion in the gravity direction in the ink bag 90.

In this case, the length of the ink outlet tube 99 is set such that the lower end of the ink outlet tube 99 is not in contact with the lower end portion in the ink bag 90 when it is filled with ink. The ink outlet tube 99 is made of a material having a specific gravity larger than that of the ink filled inside the ink bag 90. In this embodiment, the ink outlet tube 99 is made of a fluororesin that is resistant to ink.

The fluororesin is selected from among, for example, PFA (tetrafluoroethylene-perfluoroalkylvinylether copolymer, specific gravity: 2.12 to 2.17), PTFE (polytetrafluoroethylene (tetrafluoride), specific gravity: 2.14 to 2.20), FEP (tetrafluoroethylene-hexafluoropropylene copolymer (4.6 fluoride), specific gravity: 2.12 to 2.17), ETFE (tetrafluoroethylene-ethylene copolymer, specific gravity: 1.70 to 1.76), PCTFE (polychlorotrifluoroethylene (trifluoride), specific gravity: 2.10 to 2.20), PVDF (polyvinylidene fluoride (difluoride), specific gravity: 1.75 to 1.78), and the like.

If the ink is water-based ink, the specific gravity is substantially 1. Thus, if the ink outlet tube 99 is made of a material as listed above, the ink outlet tube 99 is prevented from floating upward in ink inside the ink bag 90. Accordingly, ink even at the bottom of the ink bag 90 is smoothly caused to flow out, and, thus, ink remaining in the ink bag 90 is reduced.

Furthermore, the portion of the ink outlet portion 91 extending into the ink bag 90 is provided with a communication hole 100 through which the internal portion of the ink outlet portion 91 and the internal portion of the ink bag 90 are in communication with each other. Both ends in the width direction at the upper end portion of the internal portion of the ink bag 90 are provided with inclined portions 101 as exemplary guide portions that are inclined upward toward the communication hole 100.

The diameter of the communication hole 100 is set to be smaller than that of the inlet port of ink at the lower end of the ink outlet tube 99 (on the side opposite from the ink outlet portion 91). If the ink is pigment ink, pigment is precipitated on the bottom of the ink bag 90, causing the problem that there is a difference in the concentration of ink supplied earlier and that of ink supplied later. However, according to the above-described configuration, ink in an upper portion having a low concentration is caused flow into the communication hole 100 and ink in a lower portion having a high concentration is caused flow into the ink outlet tube 99, so that the ink having a high concentration and the ink having a low concentration are mixed, and ink having an appropriate concentration is sent to the ink outlet portion 91.

Figure 17:
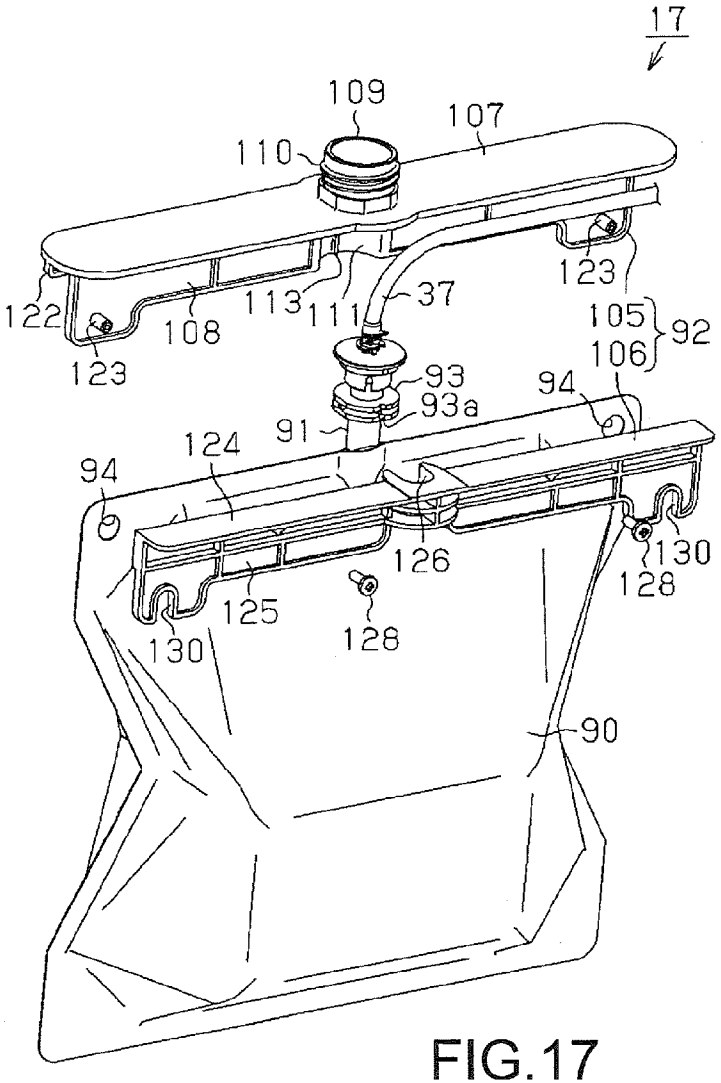
FIG. 17 is an exploded perspective view from the side opposite from that in FIG. 16.
Figure 16:
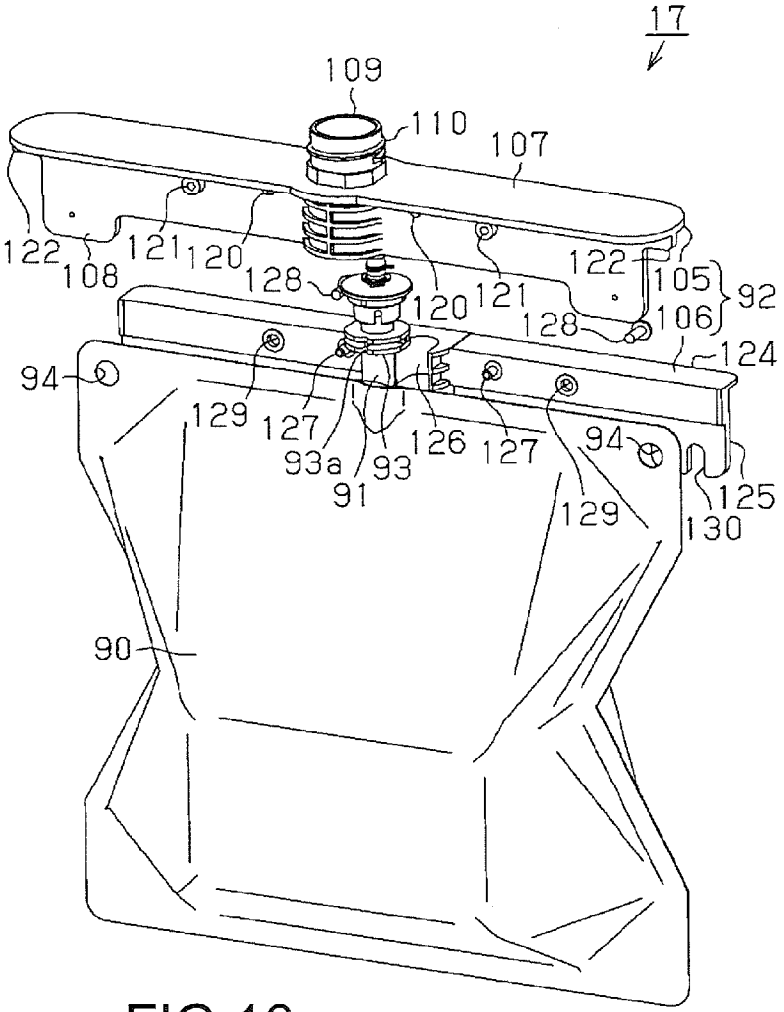
FIG. 16 is an exploded perspective view of the ink container.

As shown in FIGS. 16 and 17, the support member 92 of the ink container 17 includes a first support member 105 and a second support member 106 that are attached to the upper end portion of the ink bag 90 on both sides of the upper end portion. The first support member 105 includes a substantially rectangular top plate portion 107 extending in the width direction of the ink bag 90, and a side plate portion 108 provided perpendicularly to and unitarily with the lower face of the top plate portion 107 so as to extend along the longitudinal direction at the center in the lateral direction of the lower face.

As shown in FIGS. 16 and 17, both ends of the top plate portion 107 of the first support member 105 are substantially arc-shaped, and a cylindrical outlet portion insertion portion 109 into which the ink outlet portion 91 is inserted is formed through the center portion in the longitudinal direction of the top plate portion 107. The outer circumferential face of the outlet portion insertion portion 109 is provided with a thread ridge 110 that can be threaded with the thread groove 89 of the cap 87. Accordingly, the cap 87 can be fastened to the outlet portion insertion portion 109.

The outer diameter of the outlet portion insertion portion 109 is substantially the same as that of the flange portion 83 of the ink inlet needle 80. The inner diameter of the outlet portion insertion portion 109 is larger than the outer diameter of the needle positioning portion 84 of the ink inlet needle 80. The inner diameter of the needle positioning portion 84 is slightly larger than the outer diameter of the upper end of the ink outlet portion 91.

Figure 19:
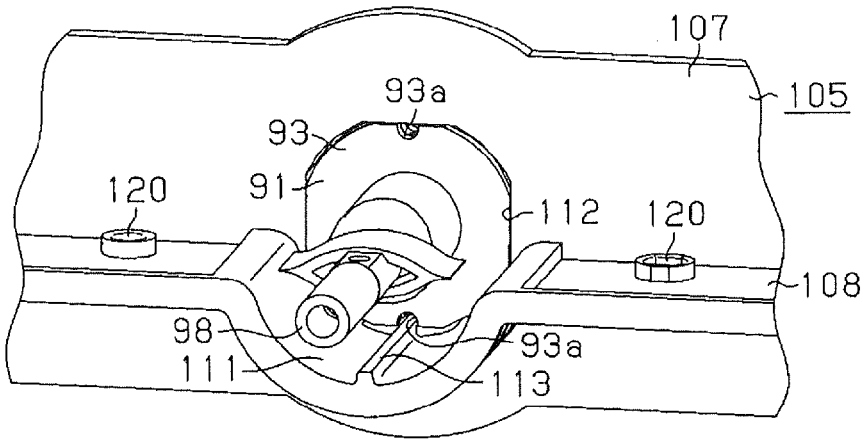
FIG. 19 is an enlarged perspective view showing the state in which a first support member and the ink outlet portion are engaged with each other.

As shown in FIGS. 17 and 19, the portion of the side plate portion 108 of the first support member 105 corresponding to the outlet portion insertion portion 109 is provided with a semicircular arc face 111 formed along part of the outlet portion insertion portion 109. The end of the outlet portion insertion portion 109 on the semicircular arc face 111 side is provided with a fitting hole 112 to which the outlet flange portion 93 of the ink outlet portion 91 can be fitted. The fitting hole 112 is substantially in the shape of a square having rounded corners so as to conform to the outlet flange portion 93.

The portion of the semicircular arc face 111 at the center to the fitting hole 112 is provided with a ridge 113 extending in the vertical direction. The upper end of the fitting hole 112 is provided with a step portion 114 that can be engaged with the outlet flange portion 93 of the ink outlet portion 91 in the vertical direction. When the ink outlet portion 91 is inserted into the outlet portion insertion portion 109, the outlet flange portion 93 is fitted to the fitting hole 112, and the flange recess portions 93*a* of the outlet flange portion 93 is fitted to the ridge 113, and, thus, the ink outlet portion 91 is positioned.

As shown in FIGS. 16 and 19, positioning holes 120 are respectively formed on both sides of the semicircular arc face 111 on the side plate portion 108 of the first support member 105. Furthermore, screw holes 121 are respectively formed on both sides of the positioning holes 120 on the side plate portion 108. The lower faces of both ends of the top plate portion 107 of the first support member 105 are provided with projecting pieces 122 in the shape of plates unitarily formed with the side plate portion 108. Furthermore, columnar projections 123 that are inserted through the ink bag penetration holes 94 of the ink bag 90 respectively project from both ends of the side plate portion 108 on the semicircular arc face 111 side.

The second support member 106 is substantially in the shape of an L-shaped plate. The second support member 106 includes a horizontal portion 124 in the shape of a rectangular plate extending in the width direction of the ink bag 90 and facing the lower face of the top plate portion 107 of the first support member 105, and a vertical portion 125 in the shape of a rectangular plate facing the side plate portion 108 of the first support member 105.

The position in the second support member 106 corresponding to the semicircular arc face 111 on the side plate portion 108 of the first support member 105 is provided with a support recess portion 126 into which the portion of the ink outlet portion 91 immediately below the outlet flange portion 93 (the portion of the ink outlet portion 91 exposed from the ink bag 90 and closer to the ink bag 90 than the outlet flange portion 93 is) is inserted. The width of the support recess portion 126 is smaller than that of the outlet flange portion 93 of the ink outlet portion 91.

Positioning protrusions 127 that are inserted into the positioning holes 120 respectively project from the positions in the vertical portion 125 of the second support member 106 corresponding to the positioning holes 120 of the first support member 105. Screw insertion holes 129 are respectively formed at the positions in the vertical portion 125 of the second support member 106 corresponding to the screw holes 121 of the first support member 105. The screws 128 are respectively screwed via the screw insertion holes 129 into the screw holes 121.

Engaging cut-out recess portions 130 are formed at the positions in the vertical portion 125 of the second support member 106 corresponding to the projections 123 of the first support member 105. The projections 123 inserted through the ink bag penetration holes 94 are engaged with the engaging cut-out recess portions 130.

Next, the operation that attaches the support member 92 to the ink bag 90 to which the ink outlet portion 91 has been secured will be described.

As shown in FIGS. 16 and 17, in order to attach the support member 92 to the ink bag 90 to which the ink outlet portion 91 has been secured, first, the ink outlet portion 91 is inserted into the support recess portion 126 of the second support member 106. Then, the projections 123 of the first support member 105 are respectively inserted through the ink bag penetration holes 94 of the ink bag 90. Then, the positioning protrusions 127 of the second support member 106 are respectively inserted into the positioning holes 120 of the first support member 105. Accordingly, the first support member 105 and the second support member 106 are positioned with respect to each other.

Then, the screws 128 are respectively inserted into the screw insertion holes 129 of the second support member 106, and then are respectively screwed into the screw holes 121 of the first support member 105. Accordingly, the support member 92 is attached to the ink bag 90 to which the ink outlet portion 91 has been secured. At that time, the support member 92 is engaged with the outlet flange portion 93 of the ink outlet portion 91 in the vertical direction, and is engaged with the ink bag penetration holes 94 arranged on both sides of the ink outlet portion 91 of the ink bag 90. That is to say, the support member 92 supports the ink outlet portion 91, and supports the ink bag 90 on both sides of the ink outlet portion 91 of the ink bag 90

Figure 21:
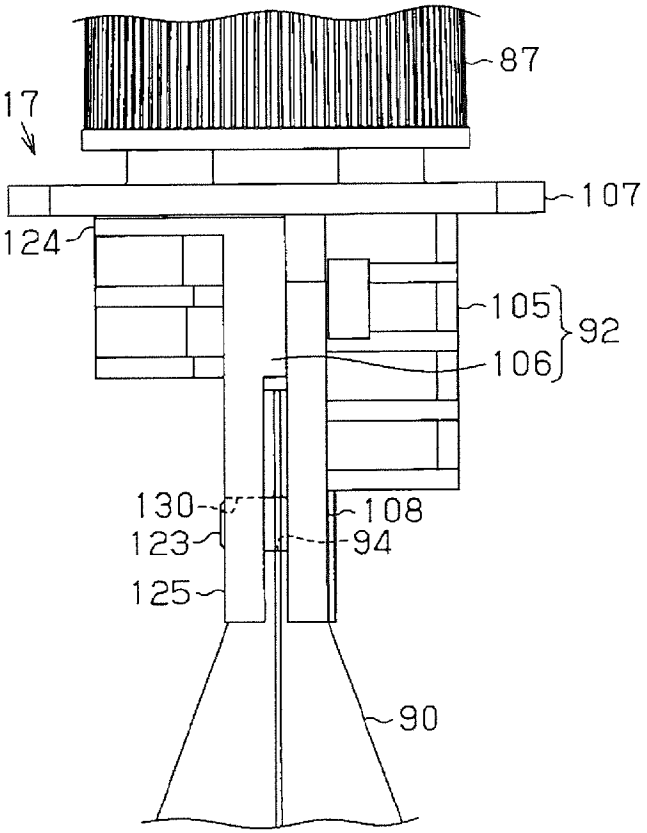
FIG. 21 is an enlarged side view of the main portion of the ink container.

At that time, as shown in FIG. 21, the upper end portion of the ink bag 90 is disposed in a gap formed between the side plate portion 108 of the first support member 105 and the vertical portion 125 of the second support member 106. Accordingly, even when the ink bag 90 is deformed as ink contained inside is consumed, the side plate portion 108 and the vertical portion 125 do not interfere with the deformation.

Next, the operation that places the ink containers 17 filled with ink into the casing 18 will be described.

Figure 22:
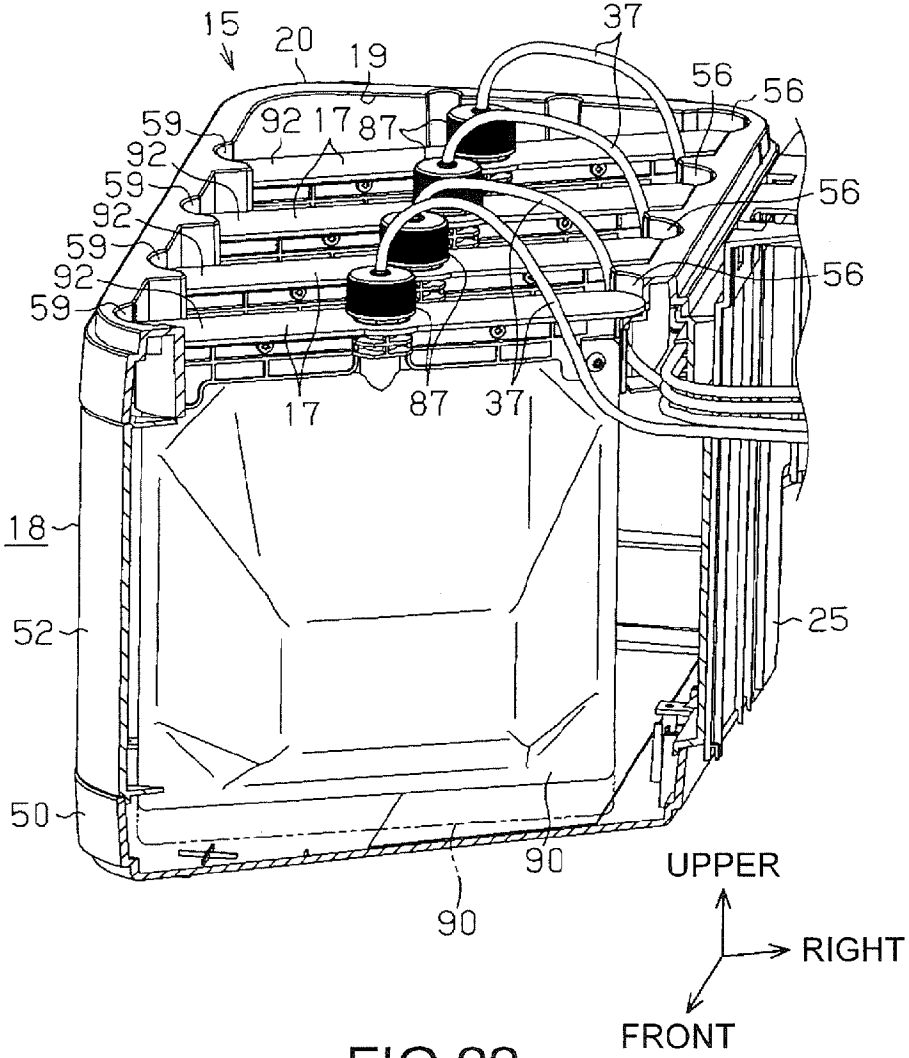
FIG. 22 is a partially cutaway perspective view of the inside of the ink supply apparatus viewed from the front.

As shown in FIGS. 3 and 22, in order to place the ink containers 17 into the casing 18, first, the lid member 21 is opened, and the ink containers 17 are accommodated through the opening portion 19 of the container main body 20 into the container main body 20. At that time, both ends of the first support member 105 of each of the ink containers 17 are supported by the right recess portion 56 and the left recess portion 59 in the direction that intersects the left-right direction at an angle of 30 degrees.

Accordingly, the projecting pieces 122 (see FIG. 16) of the first support member 105 are respectively inserted into the cut-out recess portions 56*a* (see FIG. 5) and the cut-out recess portions 59*a* (see FIG. 5). Accordingly, the ink containers 17 are accommodated in line in the front-rear direction in the container main body 20 so as to be detachably supported in the direction that intersects the left-right direction at an angle of 30 degrees. In this case, the support members 92 positioned at the upper end portion (one of the end portions) of the ink containers 17 are hanged from the right recess portions 56 and the left recess portions 59 of the container main body 20.

Accordingly, each of the ink containers 17 is suspended above the inner bottom face of the container main body 20. In the state where the ink container 17 is hanged from the container main body 20, the support member 92 supports the outlet flange portion 93 of the ink outlet portion 91 (see FIG. 16), and supports the ink bag 90 at the ink bag penetration holes 94 on both sides of the ink outlet portion 91.

Furthermore, the ink container 17 is such that the lower end portion of the ink bag 90 is lowered by a distance corresponding to the thickness reduced as ink inside the ink bag 90 is consumed (as indicated by the dashed double dotted line in FIG. 22). However, the ink container 17 is kept suspended above the inner bottom face of the container main body 20 even after ink inside the ink bag 90 has been completely consumed.

Then, as shown in FIGS. 12, 18, and 20, the ink inlet needle 80 is connected to the ink outlet portion 91 of each of the ink containers 17 accommodated inside the container main body 20 as described above. That is to say, in order to connect the ink inlet needle 80 to the ink outlet portion 91, the cap 87 attached to the ink inlet needle 80 connected to the upstream end of the connection tube 37 is placed on the outlet portion insertion portion 109 of the ink container 17.

Then, as shown in FIG. 20, the cap 87 is rotated, and, thus, the thread groove 89 of the cap 87 is threaded with the thread ridge 110 of the outlet portion insertion portion 109. With this threading operation, the ink inlet needle 80 is inserted via the ink outlet port 95*a* into the ink outlet portion 91. When the cap 87 is further rotated, and the cap 87 is completely fastened to the outlet portion insertion portion 109, the ink inlet needle 80 presses the valve member 96 downward away from the gasket 95 resisting the biasing force of the coil spring 97.

Accordingly, the valve member 96 is moved to the open position away from the gasket 95, so that the internal portion of the ink bag 90 and the internal portion of the ink inlet needle 80 are in communication with each other. Accordingly, the internal portion of the ink bag 90 is in communication with the internal portion of the connection tube 37 through the ink outlet portion 91 and the ink inlet needle 80. At that time, the needle positioning portion 84 of the ink inlet needle 80 is inserted into the outlet portion insertion portion 109, and the positioning protrusions 84*a* are as appropriate brought into contact with the inner circumferential face of the outlet portion insertion portion 109. Thus, the ink inlet needle 80 is positioned at the center of the ink outlet portion 91.

After the cap 87 is fastened to the outlet portion insertion portion 109 as shown in FIG. 3, the lid member 21 is closed, and, thus, the operation that places the ink containers 17 into the casing 18 is completed. When the ink containers 17 are placed into the casing 18, ink in the ink containers 17 is supplied from the connection tubes 37 through the ink supply needles 35 and the ink supply tubes 36 to the recording head 28. The ink supplied to the recording head 28 is jetted from the nozzles (not shown) of the recording head 28 onto the paper P, so that printing is performed.

When ink in the ink containers 17 is consumed in printing on the papers P, the ink bags 90 of the ink containers 17 are gradually flattened as the ink is consumed. Since the left peripheral wall forming member 52 forming the container main body 20 of the casing 18 is transparent, the flattened degree (displacement state) of the ink bags 90 of the ink containers 17 in the casing 18 can be seen at that time from the outside of the casing 18 through the left peripheral wall forming member 52, without opening the lid member 21.

In particular, the left peripheral wall forming member 52 occupies not only the most area in the left face of the container main body 20 but also the most area on the left half in the front face and the rear face of the container main body 20. Moreover, the ink containers 17 are arranged in line in the front-rear direction parallel to each other at an angle such that the left sides are positioned closer to the front than the right sides are in the casing 18.

Accordingly, the degree of the ink bags 90 of all ink containers 17 flattened in the casing 18 can be seen from the outside of the casing 18, that is, from the front side of the casing 18. Accordingly, the time to replace each ink container can be known based on the degree of the ink bags 90 of the ink containers 17 flattened.

Furthermore, the lower ends of the ink outlet tubes 99 inside the ink bags 90 of the ink containers 17 extend to the lower portions in the gravity direction in the ink bags 90. Accordingly, the ink inside the ink bags 90 is drawn upward from the lower end portions of the ink bags 90 through the ink outlet tubes 99, and is consumed.

In this case, the ink outlet tubes 99 are made of a material having a specific gravity larger than that of the ink filled inside the ink bags 90, and, thus, the ink outlet tubes 99 do not float upward inside the ink bags 90. Accordingly, the lower ends of the ink outlet tubes 99 are always kept in the lower portions in the gravity direction in the ink bags 90, and, thus, ink remaining in the ink bags 90 after use can be reduced.

Furthermore, the operation for replacing the ink container 17 in which no ink is left is performed after restricting the flow of ink through the connection tube 37 corresponding to the ink container 17 that is to be replaced, by causing the ink flow adjusting member 82 (see FIG. 13) attached to the connection tube 37 to flatten the connection tube 37. With this processing, when the cap 87 is removed from the outlet portion insertion portion 109 of the ink container 17 that is to be replaced and the ink inlet needle 80 is pulled out of the ink outlet portion 91, dropping of ink from the inlet hole 80*a* of the ink inlet needle 80 is suppressed.

Next, the operation performed when causing the reading device 13 of the image forming system 11 to read the document G that is larger than the reading face 13*a* will be described.

As shown in FIG. 2, when causing the reading device 13 to read the document G that is larger than the reading face 13*a*, first, the automatic document feeder 16 is opened so that the reading face 13*a* is exposed. Then, the document G is placed such that a region that is to be read in the document G is included within the reading face 13*a* and such that part of the portion of the document G protruding out of the reading face 13*a* is positioned on the casing 18 (on the lid member 21).

At that time, the height of the casing 18 is equivalent to that of the reading face 13*a*. That is to say, the height of the casing 18 is lower than that of the reading face 13*a* by 5 mm. Accordingly, the document G is supported on the casing 18 without any part of the document G being caught by the peripheral face of the casing 18. When the reading device 13 operates in a state where the automatic document feeder 16 is closed, the region of the document G on the reading face 13*a* is read.

In this manner, the part of the document G protruding out of the reading face 13*a* is supported by the casing 18. Thus, the document G is stably positioned, and the document G can be precisely read by the reading device 13.

According to the embodiment described above in detail, the following effects can be achieved.

(1) In the ink supply apparatus 15, each of the ink containers 17 is detachably supported by the right recess portion 56 and the left recess portion 59 of the casing 18 such that the ink outlet portion 91 is positioned on the upper side in the gravity direction of the ink bag 90. Accordingly, the ink outlet portion 91 and the ink inlet needle 80 can be readily and reliably connected to each other while looking at these portions to be connected. Typically, ink is collected under its own weight in the lower portion of the ink bag 90. Thus, if the ink outlet portion 91 is at the lower portion of the ink bag 90, the ink leakage amount may increase when a connection failure occurs between the ink outlet portion 91 and the ink inlet needle 80. However, according to the above-described configuration, the ink outlet portion 91 is positioned on the upper side in the gravity direction of the ink bag 90, and, thus, the ink leakage amount can be suppressed even when a connection failure occurs between the ink outlet portion 91 and the ink inlet needle 80.

(2) The ink bag 90 is a bag member configured by the two flexible films 90*a* facing each other, and is formed such that the two facing flexible films 90*a* approach each other as ink contained inside is consumed. Accordingly, the state of ink inside the ink bag 90 consumed can be easily known by looking at the state of the flexible films 90*a* displaced as the ink inside the ink bag 90 is consumed.

(3) The casing 18 has the bottom wall 49, the opening portion 19 facing the bottom wall 49 and formed above the bottom wall 49 in the gravity direction, and the lid member 21 that covers the opening portion 19 in an openable/closable manner. The ink containers 17 are detachably accommodated through the opening portion 19 into the casing 18. With this configuration, the ink containers 17 are attached to and detached from the casing 18 through the opening portion 19 that is formed in the upper portion in the gravity direction of the casing 18. Thus, the ink containers 17 can be readily attached to and detached from the casing 18. Moreover, after the ink containers 17 are accommodated into the casing 18, the opening portion 19 can be covered by the lid member 21. Thus, damage to the ink containers 17 and the connection tubes 37 and accidental disconnection of the ink outlet portions 91 from the ink inlet needles 80 can be suppressed. Accordingly, a supply failure of ink and contamination with ink can be suppressed. Furthermore, the ink outlet portion 91 and the ink inlet needle 80 can be connected and disconnected above the casing 18 having the bottom wall 49. Thus, even when ink drops, the ink droplets can be received by the casing 18. Accordingly, contamination outside the casing 18 with ink can be suppressed.

(4) The casing 18 has the transparent left peripheral wall forming member 52 through which the degree of the ink bags 90 flattened as ink inside the ink containers 17 is consumed can be seen. Accordingly, the degree of the ink bags 90 of the ink containers 17 flattened in the casing 18 can be seen from the outside of the casing 18. That is to say, the degree of ink in the ink containers 17 consumed in the casing 18 can be checked from the outside of the casing 18.

(5) The distance between the right peripheral wall 45 and the left peripheral wall 46 in the casing 18 is smaller than the width of the ink containers 17. Accordingly, the ink containers 17 are accommodated at an angle inside the casing 18, and, thus, the size of the casing 18 can be reduced.

(6) The ink outlet portion 91 of each of the ink containers 17 is formed at the upper end portion of the ink bag 90. The ink container 17 includes, at the upper end portion thereof on the side where the ink outlet portion 91 is formed, the support member 92 that can be engaged with the upper end portion. The ink container 17 is supported by means of the support member 92 by the right recess portion 56 and the left recess portion 59 of the casing 18. With this configuration, the ink container 17 is supported, at the upper end portion thereof on the side where the ink outlet portion 91 is formed, by the right recess portion 56 and the left recess portion 59 of the casing 18. Thus, the ink outlet portion 91 and the ink inlet needle 80 can be readily connected to each other. Furthermore, since the ink container 17 is provided with the support member 92, the ink container 17 can be handled while holding the support member 92. Accordingly, the ink container 17 can be readily attached to and detached from the right recess portion 56 and the left recess portion 59 of the casing 18.

(7) The ink container 17 is supported and hanged, at the upper end portion thereof on the side where the ink outlet portion 91 is formed, from the right recess portion 56 and the left recess portion 59 of the casing 18. With this configuration, since the ink container 17 is hanged, ink is collected under its own weight in the lower portion of the ink container 17, and, thus, the ink bag 90 is tensioned. Accordingly, the ink bag 90 becomes flattened straight with no crease or twist as ink inside the ink bag 90 is consumed, and, thus, the ink can be stably supplied to the inkjet printer 12. Furthermore, in this embodiment, the inkjet printer 12 is a printer in which the carriage 27 carrying the recording head 28 travels. Thus, vibration of the inkjet printer 12 is transmitted to the ink containers 17, and the lower portions of the ink containers 17 swing. Furthermore, since the support members 92 at the upper end portions of the ink containers 17 are each arranged in a direction intersecting the travel direction (main-scanning direction) of the carriage 27 in a plan view, vibration caused by travel of the carriage 27 is readily transmitted to the ink containers 17 compared with the case in which the support members 92 are arranged in a direction parallel to the main-scanning direction. Accordingly, if the ink inside the ink bags 90 is pigment ink containing pigment that tends to be precipitated in the ink, the pigment ink can be stirred by the swinging of the lower portions of the ink containers 17. Accordingly, a difference in the concentration of pigment in the pigment ink can be suppressed.

(8) The support member 92 of each of the ink containers 17 supports the ink outlet portion 91 of the ink container 17. Accordingly, the ink bag 90 of the ink container 17 becomes flattened straight with no crease or twist as ink inside the ink bag 90 is consumed, and, thus, the ink can be stably supplied to the inkjet printer 12.

(9) The support member 92 of the ink container 17 supports the ink bag 90 on both sides of the ink outlet portion 91. Accordingly, the ink bag 90 can be stably supported in a well-balanced manner by the support members 92.

(10) The ink container 17 has the channel 99*a* in communication with the ink outlet portion 91 and extending to the lower portion in the gravity direction of the ink bag 90. With this configuration, even when the ink outlet portion 91 is positioned at the upper portion of the ink bag 90, ink can be drawn upward from the lower portion in the ink bag 90 through the channel 99*a*, and, thus, the ink inside the ink bag 90 can be stably supplied to the inkjet printer 12.

(11) The ink outlet tube 99 of the ink container 17 is made of a material having a specific gravity larger than that of the ink contained in the ink bag 90. Accordingly, upward floating of the ink outlet tube 99 in the ink inside the ink bag 90 can be suppressed. Accordingly, ink positioned at the lower end portion in the ink bag 90 on the side opposite from the ink outlet portion 91 can be smoothly guided by the ink outlet tube 99 to the ink outlet portion 91, and, thus, ink remaining in the ink bag 90 can be reduced.

(12) The portion of the ink outlet portion 91 of the ink container 17 extending into the ink bag 90 has the communication hole 100 in communication with the internal portion of the ink bag 90. With this configuration, when injecting ink into the ink bag 90 through the ink outlet portion 91 on the upper side in the vertical direction of the ink bag 90, air bubbles mixed in ink inside the ink bag 90 can be discharged out of the ink container 17 through the communication hole 100 of the ink outlet portion 91.

(13) The internal portion of the ink bag 90 of the ink container 17 on the ink outlet portion 91 side is provided with the inclined portions 101 that are inclined upward toward the communication hole 100. Accordingly, when injecting ink into the ink bag 90 through the ink outlet portion 91 on the upper side in the vertical direction of the ink bag 90, air bubbles mixed in ink inside the ink bag 90 can be guided by the inclined portions 101 toward the communication hole 100. As a result, air bubbles mixed in ink inside the ink bag 90 can be smoothly discharged out of the ink container 17 through the communication hole 100.

(14) The ink outlet tube 99 of the ink container 17 is connected via the flexible connection channel member 98 to the ink outlet portion 91. Accordingly, the ink outlet tube 99 can be readily connected via the connection channel member 98 to the ink outlet portion 91.

(15) The internal face of the container main body 20 of the casing 18 is provided with the first to the fourth tube support portions 65 and 73 to 75 for guiding the connection tubes 37 connected to the ink containers 17 accommodated inside the container main body 20. Accordingly, the first to the fourth tube support portions 65 and 73 to 75 can guide the connection tubes 37 inside the container main body 20, and, thus, the connection tubes 37 can be readily arranged inside the container main body 20.

(16) The internal face of the right peripheral wall forming member 51 of the container main body 20 of the casing 18 is provided with the container-side through hole 61 into which the connection tubes 37 can be inserted. The first to the fourth tube support portions 65 and 73 to 75 guide the connection tubes 37 between the container-side through hole 61 and the ink containers 17 accommodated inside the container main body 20. Accordingly, the connection tubes 37 inserted from the container-side through hole 61 into the container main body 20 can be guided by the first to the fourth tube support portions 65 and 73 to 75 to the ink containers 17 accommodated inside the container main body 20.

(17) The first to the fourth tube support portions 65 and 73 to 75 in the casing 18 have lengths that vary in accordance with the distance to the container-side through hole 61 from the ink container 17 connected to the connection tube 37 guided by each tube support portion. Accordingly, connection of each of the connection tubes 37 to a wrong ink container 17 can be suppressed.

(18) The container main body 20 of the casing 18 includes the edge member 53 forming the peripheral edge of the opening portion 19 through which the ink containers 17 are to be accommodated. The edge member 53 covers the first to the fourth tube support portions 65 and 73 to 75. Accordingly, the edge member 53 can protect the connection tubes 37 guided by the first to the fourth tube support portions 65 and 73 to 75.

(19) The edge member 53 of the casing 18 is provided with the cut-out portions 57 through which the connection tubes 37 can be inserted. Accordingly, the connection tubes 37 can be inserted through the cut-out portions 57, and, thus, the connection tubes 37 can be readily connected to the ink containers 17.

(20) The edge member 53 of the casing 18 includes the right recess portions 56 and the left recess portions 59 for supporting the ink containers 17. Accordingly, the ink containers 17 can be supported by the right recess portions 56 and the left recess portions 59.

(21) The third and the fourth tube support portions 74 and 75 of the casing 18 are provided with the protrusions 76 for suppressing detachment of the connection tubes 37 from the third and the fourth tube support portions 74 and 75. Accordingly, the protrusions 76 can suppress detachment of the connection tubes 37 from the third and the fourth tube support portions 74 and 75.

(22) The penetration holes 77 are respectively formed on both sides of the second to the fourth tube support portions 73 to 75 on the internal face of the container main body 20 of the casing 18. Accordingly, the connection tubes 37 can be readily and reliably held respectively in the second to the fourth tube support portions 73 to 75, by inserting a wire into each of the penetration holes 77 and connecting ends of the wire to each other to form a ring.

(23) The peripheral wall of the container main body 20 of the casing 18 is formed by combining the right peripheral wall forming member 51 and the left peripheral wall forming member 52 separated into left and right members. Accordingly, the peripheral wall of the container main body 20 of the casing 18 can be readily formed.

(24) The ink supply apparatus 15 includes the casing 18, the ink containers 17 accommodated inside the casing 18, and the connection tubes 37 connected to the ink containers 17. Accordingly, ink in the ink containers 17 accommodated inside the casing 18 can be supplied through the connection tubes 37 to the inkjet printer 12.

(25) The inkjet printer 12 includes the recording head 28 that can jet ink supplied through the connection tubes 37 of the ink supply apparatus 15 onto the paper P. Accordingly, printing can be performed on the paper P by jetting ink supplied through the connection tubes 37 of the ink supply apparatus 15, from the recording head 28 onto the paper P.

(26) In the image forming system 11, the casing 18 is disposed adjacent to the image forming apparatus 14 so as to have a height equivalent to that of the reading face 13*a*. Accordingly, when reading the document G that is larger than the reading face 13*a*, part of the document G can be supported by the casing 18.

(27) In the image forming system 11, the height of the casing 18 is lower than that of the reading face 13*a*. Accordingly, when the document G that is larger than the reading face 13*a* is placed on the reading face 13*a*, the document G can be prevented from being caught by the casing 18.

(28) In the image forming system 11, the casing 18 is detachably attached to the inkjet printer 12 of the image forming apparatus 14. Accordingly, the casing 18 can be freely attached to and detached from the inkjet printer 12.

Modified Example

Note that the foregoing embodiment may be modified as follows.

Figure 23:
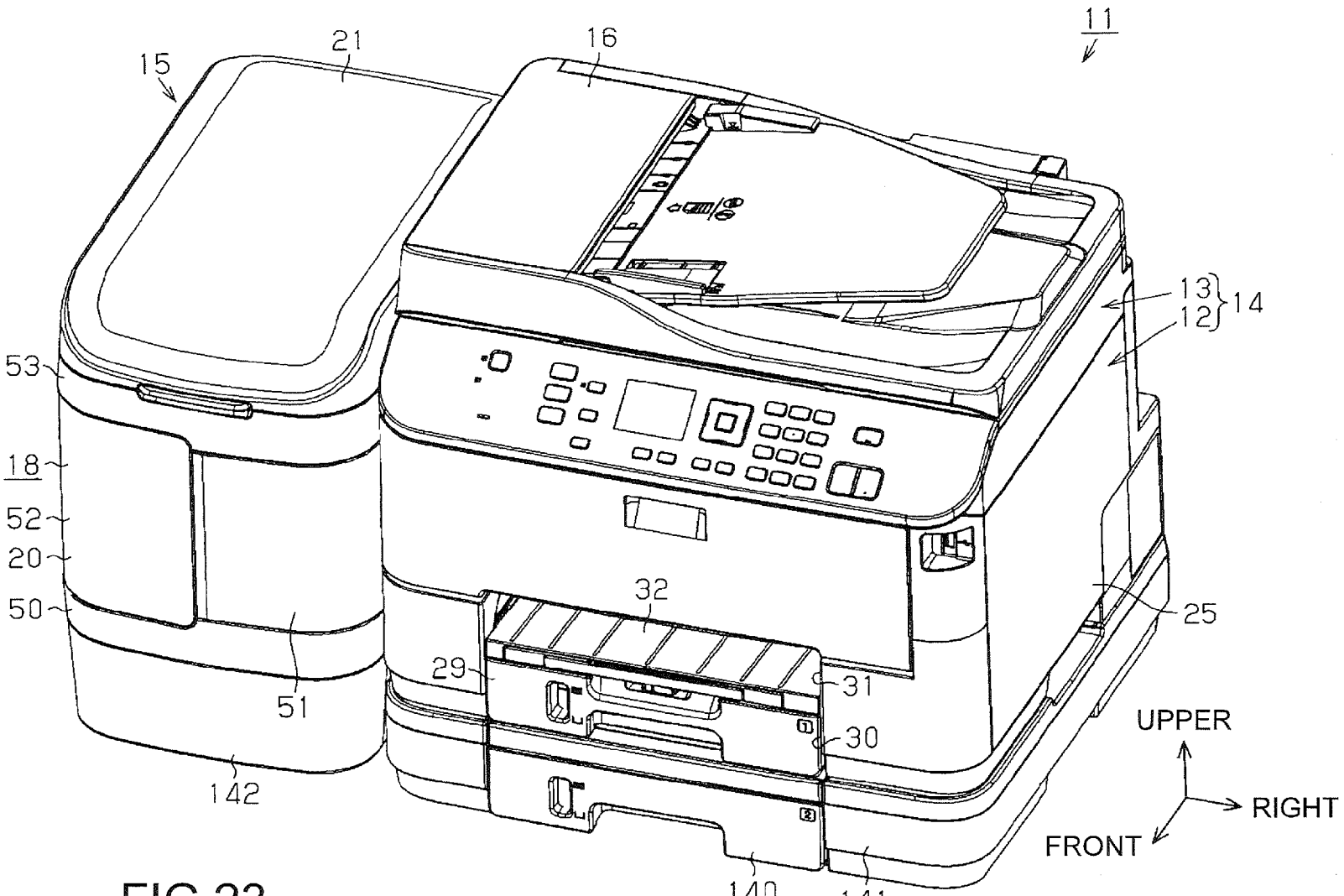
FIG. 23 is a perspective view of an image forming system according to a modified example.

As shown in FIG. 23, in the image forming system 11, an optional cassette unit 141 having an optional paper cassette 140 may be provided on the lower side of the image forming apparatus 14. In this case, a pedestal base 142 is provided on the lower side of the casing 18, as an exemplary adjusting member for adjusting the height of the casing 18 such that the height increases by the degree according to a change by which the height of the image forming apparatus 14 has increased. If the optional cassette unit 141 and the pedestal base 142 are provided in combination in the image forming system 11 in this manner, the relationship between the height of the casing 18 and that of the reading face 13*a* can be maintained.

Hereinafter, the configuration of the pedestal base 142 will be described in detail.

Figure 24:
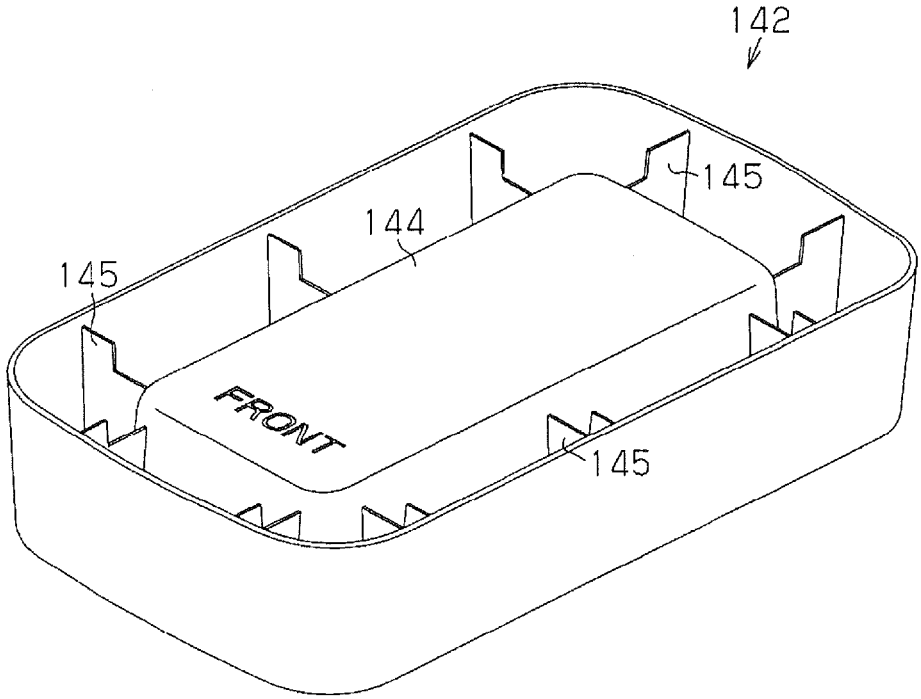
FIG. 24 is a perspective view of a pedestal base of the image forming system.
Figure 25:
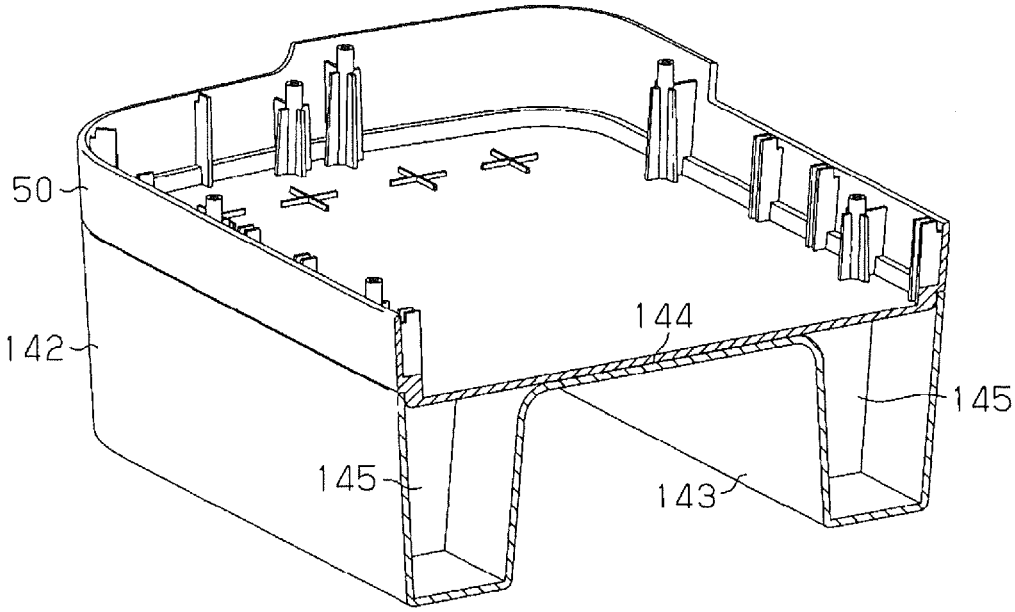
FIG. 25 is a cross-sectional perspective view showing the state in which the pedestal base is attached to a lower face of a bottom wall forming member of the casing.

As shown in FIGS. 24 and 25, the pedestal base 142 is in the shape of a bottomed rectangular box whose center portion of the lower face has a recess portion 143 recessed in the shape of a rectangle. The center on the inner bottom face of the pedestal base 142 is provided with an elevated portion 144 elevated by the height by which recess portion 143 has been recessed. The upper face of the elevated portion 144 is flat. A plurality of (ten, in this example) support ribs 145 in the shape of plates are as appropriate arranged spaced away from each other so as to surround the elevated portion 144, around the elevated portion 144 on the inner bottom face of the pedestal base 142. When attaching the pedestal base 142 to the lower side of the casing 18, the elevated portion 144 is secured using a double-sided adhesive tape (not shown) to the center on the lower face of the bottom wall forming member 50 forming the casing 18, and the peripheral edge on the upper end of the pedestal base 142 is engaged with the peripheral edge on the lower face of the bottom wall forming member 50.

Figure 26:
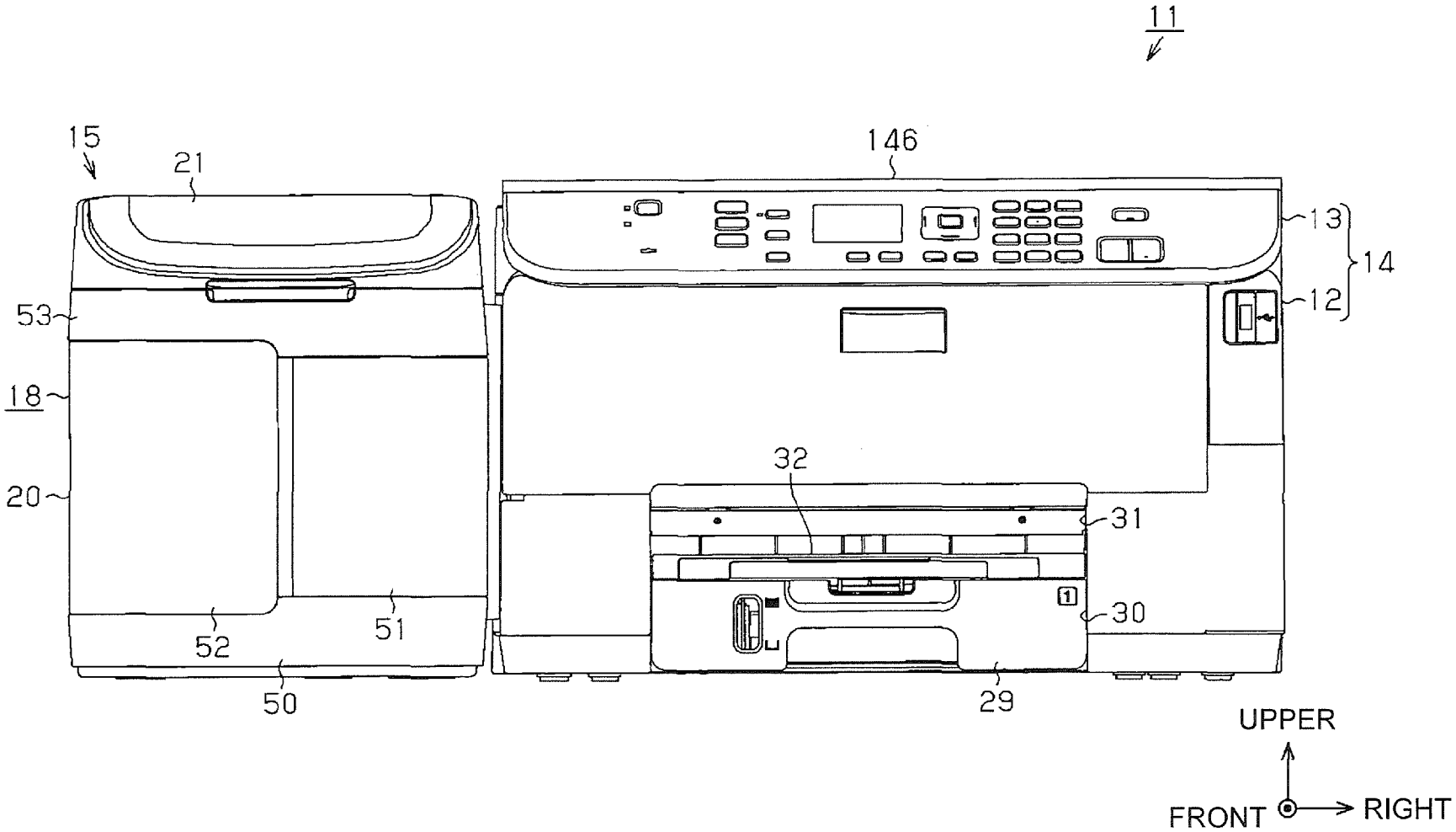
FIG. 26 is a front view of an image forming system according to a modified example.

As shown in FIG. 26, in the image forming system 11, the automatic document feeder 16 may be replaced by a lid member 146 that can expose and cover the reading face 13*a*.

Figure 27:
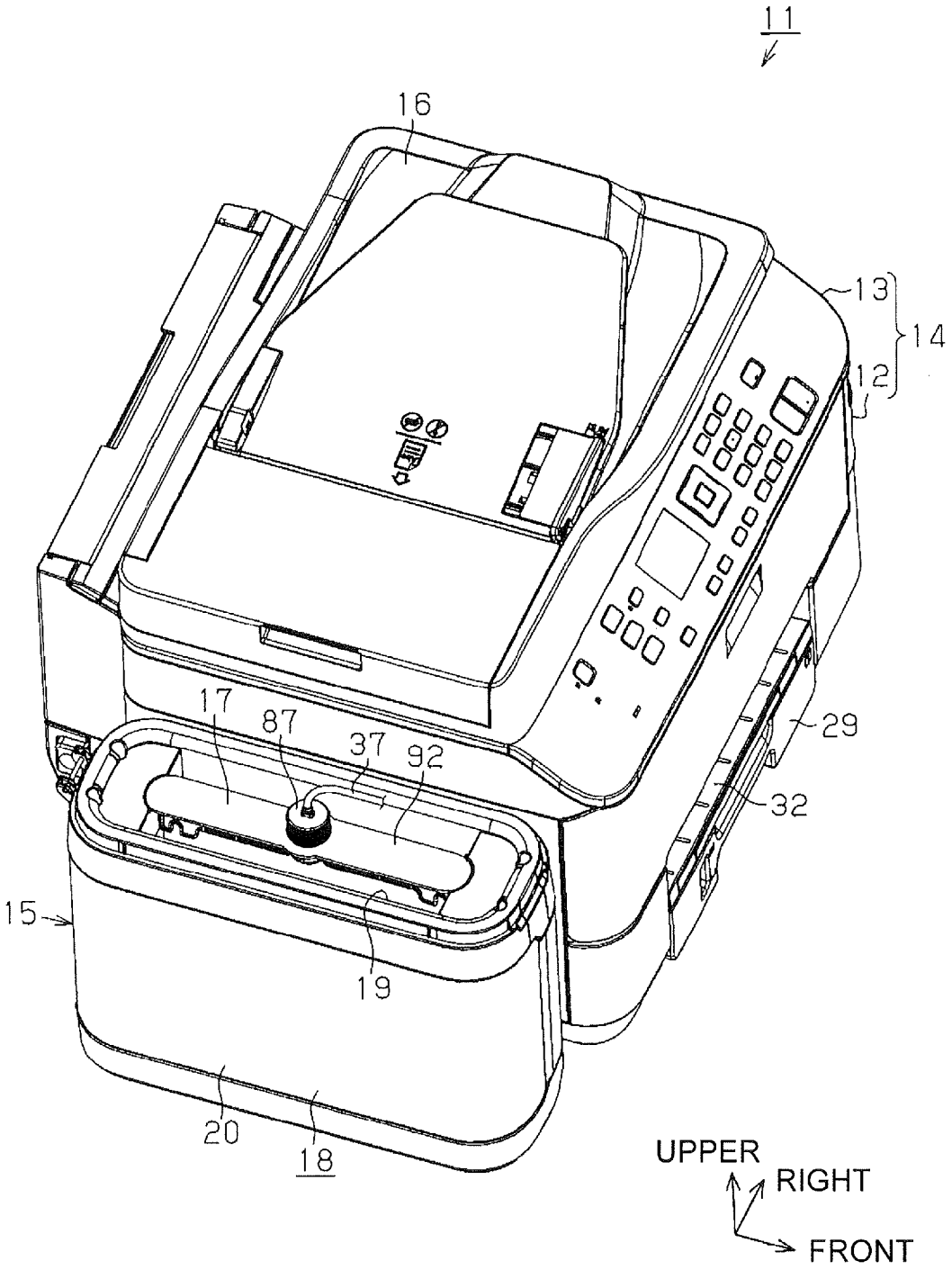
FIG. 27 is a perspective view of an image forming system according to a modified example.

As shown in FIG. 27, in the image forming system 11, if the inkjet printer 12 is a monochrome printer using only black ink, the casing 18 of the ink supply apparatus 15 may be replaced by a casing having a size that allows only one ink container 17 containing black ink to be accommodated therein. In this case, the ink container 17 is accommodated inside the casing 18 such that its width direction conforms to the front-rear direction. Note that, in FIG. 27, the lid member 21 that covers the opening portion 19 of the casing 18 in an openable/closable manner has been omitted.

Figure 28:
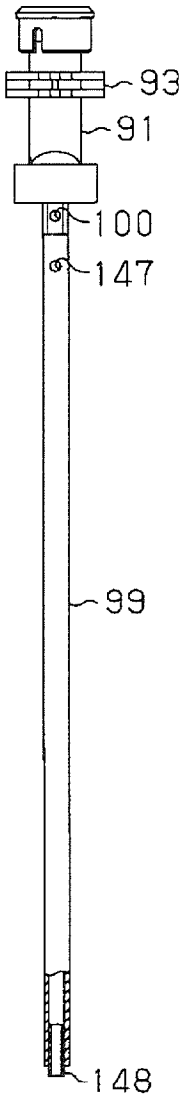
FIG. 28 is a side view of an ink outlet tube according to a modified example.

As shown in FIG. 28, the upper end of the ink outlet tube 99 may be provided with a communication hole 147 through which the internal portion of the ink outlet tube 99 and the internal portion of the ink bag 90 are in communication with each other. With this configuration, when injecting ink into the ink bag 90 in a state where the ink outlet portion 91 is disposed on the upper side in the vertical direction of the ink bag 90, air bubbles mixed in ink inside the ink bag 90 can be discharged out of the ink container 17 through the communication hole 147. In this case, the communication hole 100 of the ink outlet portion 91 may be omitted.

As shown in FIG. 28, a weight 148 may be provided at the lower end of the ink outlet tube 99 on the side opposite from the ink outlet portion 91. The weight 148 is cylindrical, and is fitted into the lower end of the ink outlet tube 99. In this case, the ink outlet tube 99 does not necessarily have to be made of a material having a specific gravity larger than that of the ink filled inside the ink bag 90. With this configuration, upward floating of the ink outlet tube 99 in the ink inside the ink bag 90 can be effectively suppressed. Accordingly, ink positioned at the lower end portion in the ink bag 90 on the side opposite from the ink outlet portion 91 can be guided by the ink outlet tube 99 to the ink outlet portion 91, and, thus, ink remaining in the ink bag 90 can be reduced. Furthermore, if a cylindrical tube is used as a weight, the tube may be made of a flexible material such as elastomer, as in the case of the connection channel member 98. In this case, even if the ink outlet tube 99 is made of a relatively hard material, damage to the ink bag 90 can be prevented.

Figure 29:
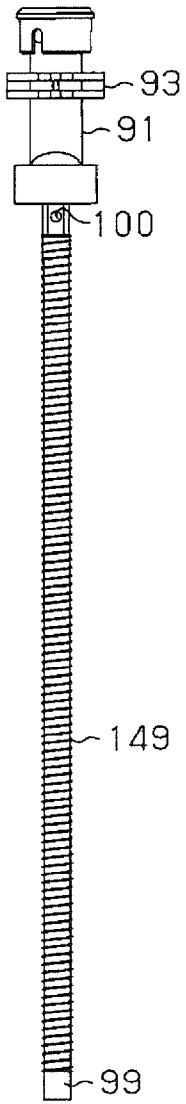
FIG. 29 is a side view showing the state in which an ink outlet tube is covered by a cover member according to a modified example.

As shown in FIG. 29, the ink outlet tube 99 may be covered by a cover member 149. In this case, the cover member 149 is configured, for example, by a coil spring. With this configuration, upward floating of the ink outlet tube 99 in the ink inside the ink bag 90 can be suppressed by the weight of the cover member 149. In this case, the average specific gravity of materials forming the ink outlet tube 99 and the cover member 149 is preferably larger than the specific gravity of the ink filled inside the ink bag 90. In this case, if the weight 148 is attached to the lower end of the ink outlet tube 99, the ink outlet tube 99 does not necessarily have to be made of a material having a specific gravity larger than that of the ink filled inside the ink bag 90.

Figure 30:
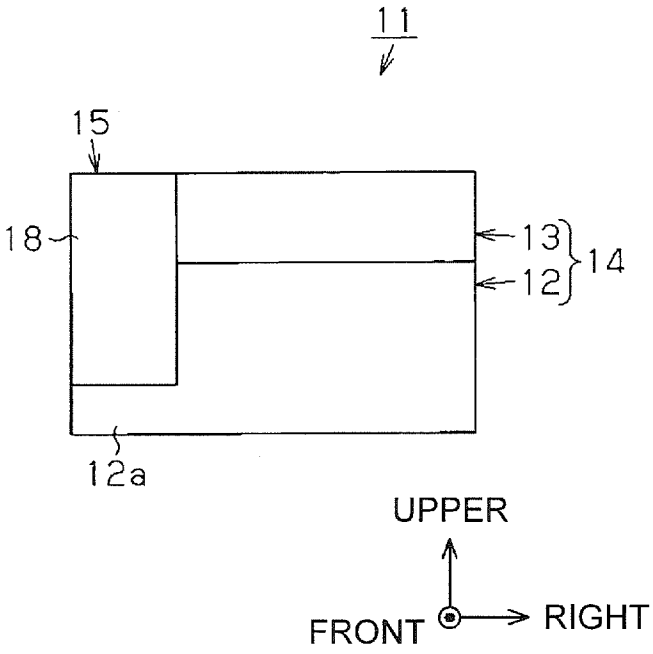
FIG. 30 is a front schematic view of an image forming system according to a modified example.

As shown in FIG. 30, in the image forming system 11, the casing 18 may be disposed adjacent to the reading device 13 so as to have a height equivalent to that of the upper face of the reading face 13*a*. In this case, an extending portion 12*a* that can support the casing 18 may extend from the side face of the inkjet printer 12, and may be used to support the casing 18.

In the ink container 17, the ink outlet tube 99 forming the channel 99*a* may be omitted.

The support member 92 of the ink container 17 does not necessarily have to support the ink bag 90 on both sides of the ink outlet portion 91.

The support member 92 of the ink container 17 does not necessarily have to support the ink outlet portion 91 of the ink container 17.

The ink container 17 does not necessarily have to be supported and hanged, at the upper end portion thereof on the side where the ink outlet portion 91 is formed, from the right recess portion 56 and the left recess portion 59 of the casing 18. That is to say, the ink container 17 may be accommodated so as to be placed on the inner bottom face of the casing 18. In this case, the inner bottom face (the bottom wall 49) of the casing 18 functions as a support portion for supporting the ink container 17.

A hard support portion having a shape that allows the support portion to be supported by the right recess portion 56 and the left recess portion 59 of the casing 18 may be provided as a liquid container support portion instead of the support members 92, at the upper end portion (end portion on the ink outlet portion 91 side) of the ink bag 90 of the ink container 17. With this configuration, the ink container 17 can be handled while holding the support portion. Accordingly, the ink container 17 can be readily attached to and detached from the right recess portion 56 and the left recess portion 59 of the casing 18.

The ink container 17 does not necessarily have to be supported by means of the support member 92 by the right recess portion 56 and the left recess portion 59 of the casing 18.

The distance between the right peripheral wall 45 and the left peripheral wall 46 in the casing 18 does not necessarily have to be smaller than the width of the ink containers 17.

The casing 18 does not necessarily have to have the transparent left peripheral wall forming member 52 through which the degree of the ink bags 90 flattened as ink inside the ink containers 17 is consumed can be seen.

The opening portion 19 of the casing 18 does not necessarily have to be provided at the upper end portion of the container main body 20, and may be provided on the side face of the container main body 20.

The lid member 21 of the casing 18 may be omitted.

The whole of the ink bag 90 does not necessarily have to be configured by the flexible films 90*a*. That is to say, only part of the ink bag 90 may be configured by a flexible portion made of a flexible material. Furthermore, a material forming the flexible portion of the ink bag 90 may or may not be transparent.

The ink container 17 does not necessarily have to be detachably supported by the right recess portion 56 and the left recess portion 59 of the casing 18 such that the ink outlet portion 91 is positioned on the upper side in the gravity direction of the ink bag 90.

The ink inlet needle 80 may be omitted, and the end of the connection tube 37 may be directly connected to the ink outlet portion 91. In this case, the end of the connection tube 37 connected to the ink outlet portion 91 functions as a liquid inlet portion.

The ink outlet tube 99 of the ink container 17 does not necessarily have to be connected via the flexible connection channel member 98 to the ink outlet portion 91. That is to say, the ink outlet tube 99 may be connected to the ink outlet portion 91 using a bonding agent, an adhesive tape, or the like.

The internal portion of the ink bag 90 of the ink container 17 may be provided with curved portions that are curved upward toward the communication hole 100, as guide portions, instead of the inclined portions 101.

The communication hole 100 at the ink outlet portion 91 of the ink container 17 may be omitted.

The ink outlet tube 99 of the ink container 17 does not necessarily have to be made of a material having a specific gravity larger than that of the ink contained in the ink bag 90.

The ink outlet tube 99 of the ink container 17 may be configured such that only part on the lower end side opposite from the ink outlet portion 91 is made of a material having a specific gravity larger than that of the ink contained in the ink bag 90.

The peripheral wall of the container main body 20 of the casing 18 does not necessarily have to be formed by combining the right peripheral wall forming member 51 and the left peripheral wall forming member 52 separated into left and right members. That is to say, the peripheral wall of the container main body 20 may be formed by combining three or more separate members, or may be configured by one member that has not been separated.

The penetration holes 77 formed through the container main body 20 of the casing 18 may be omitted.

The protrusions 76 formed on the third and the fourth tube support portions 74 and 75 of the casing 18 may be omitted.

The cut-out portions 57 provided through the edge member 53 of the casing 18 may be omitted.

The edge member 53 of the casing 18 may be provided with holes through which the connection tubes 37 can be inserted, as through portions, instead of the cut-out portions 57.

The edge member 53 of the casing 18 does not necessarily have to cover the first to the fourth tube support portions 65 and 73 to 75.

The first to the fourth tube support portions 65 and 73 to 75 in the casing 18 do not necessarily have to have lengths that vary in accordance with the distance to the container-side through hole 61 from the ink container 17 connected to the connection tube 37 guided by each tube support portion.

The first to the fourth tube support portions 65 and 73 to 75 of the casing 18 do not necessarily have to guide the connection tubes 37 between the container-side through hole 61 and the ink containers 17 accommodated inside the container main body 20.

The first to the fourth tube support portions 65 and 73 to 75 of the casing 18 may be omitted.

The guide portion may be configured only by detachment suppressing portions (the protrusions 76).

The guide portion may have any configuration as long as the connection tubes 37 can be guided along the internal face of the container main body 20 to the ink containers 17. For example, the guide portion may be configured by recess grooves that are provided in the internal face of the container main body 20.

The right peripheral wall forming member 51 and the left peripheral wall forming member 52 forming the container main body 20 may be plates each bent in the shape of an L.

The protrusions 76 may be formed throughout the ribs 66 to 69, or may be formed only at part of the ribs 66 to 69.

The size or the shape of the protrusions 76 may be freely changed as long as each of the protrusions 76 has a width that allows the protrusion to be in contact with the connection tube 37.

Each of the caps 87 may have the same color as that of the ink contained in the ink container 17 corresponding to the cap 87. With this configuration, connection of each of the caps 87 to a wrong ink container 17 can be suppressed.

In the image forming system 11, the casing 18 does not necessarily have to be detachably attached to the inkjet printer 12 of the image forming apparatus 14. That is to say, the casing 18 may be secured to the inkjet printer 12 of the image forming apparatus 14.

In the image forming system 11, the height of the casing 18 does not necessarily have to be lower than that of the reading face 13*a*. That is to say, the height of the casing 18 may be the same as or higher than that of the reading face 13*a*.

Plastic films, cloths, metal foils, or the like may be used as a target instead of the paper P.

Plastic films, cloths, metal foils, or the like may be used as a medium instead of the document G.

In the foregoing embodiment, the liquid-jet device may be a liquid-jet device that jets or ejects liquid other than ink. Examples of the state of liquid that is ejected as minuscule droplets from the liquid-jet device include a spherical shape, a tear shape, and a shape having a thread-like trailing end. Furthermore, the liquid in this case may be any material that can be jetted from the liquid-jet device. For example, the liquid may be any material that is in a liquid phase, and examples thereof include materials in a liquid state having high or low viscosity, sol, gel water, and other materials that flow, such as inorganic solvent, organic solvent, solution, liquid resin, liquid metal (metallic melt), and the like. Furthermore, the examples include not only liquid, as one state of materials, but also materials in which solvent contains dissolved, dispersed, or mixed particles of functional material made of a solid, such as pigments or metal particles. Typical examples of the liquid include ink as described in the foregoing embodiment, liquid that is applied to a printing target medium before or after the printing with ink, liquid for humidifying or cleaning liquid-jet nozzles of a liquid-jet device, liquid crystal, and the like. Incidentally, it is assumed that examples of the ink include various liquid state compositions such as commonly used water-based ink, oil-based ink, gel ink, and hot melt ink. Specific examples of the liquid-jet device include liquid-jet devices that jet liquid containing dispersed or dissolved materials such as electrode materials or coloring material used for producing liquid crystal displays, electro luminescence (EL) displays, field emission displays, color filters, and the like. The examples may further include liquid-jet devices that jet bioorganic materials used to manufacture biochips, liquid-jet devices that are used as precision pipettes and jet sample liquid, textile printing devices, micro-dispensers, and the like. The examples may further include liquid-jet devices that jet lubricating oil for pinpoint application onto precision machines such as watches or cameras, liquid-jet devices that jet transparent resin liquid such as ultraviolet curing resin onto a substrate in order to form minute hemispherical lenses (optical lenses) used for optical communications devices or the like. The examples may further include liquid-jet devices that jet acidic or alkaline etching liquid in order to perform etching on a substrate or the like.

What is claimed is:

1. A liquid supply apparatus for supplying liquid to a liquid-jet head, comprising:

a liquid container that has a liquid containing portion at least partially having a flexible portion, and a liquid outlet portion in communication with the liquid containing portion;

a support portion that supports at least part of the liquid container;

a liquid inlet portion that can be connected to the liquid outlet portion;

a channel member that connects the liquid inlet portion and the liquid-jet head; and a casing that accommodates the liquid container and is provided with the support portion;

wherein the liquid container is detachably supported by the support portion; and wherein the casing has a see-through portion through which a state of the flexible portion, that is displaced as the liquid inside the liquid container is consumed, can be seen.

2. The liquid supply apparatus according to claim 1, wherein the liquid containing portion is a bag member having flexible walls facing each other, and is formed such that the facing walls approach each other as the liquid is consumed.

3. The liquid supply apparatus according to claim 1, wherein the liquid container has a channel in communication with the liquid outlet portion and extending to a lower portion in the gravity direction of the liquid containing portion.

4. The liquid supply apparatus according to claim 1, wherein the liquid container is detachably supported by the support portion such that liquid outlet portion is positioned on an upper side in the gravity direction of the liquid containing portion.

5. A liquid supply apparatus for supplying liquid to a liquid-jet head, comprising:

a liquid container that has a liquid containing portion at least partially having a flexible portion, and a liquid outlet portion in communication with the liquid containing portion;

a support portion that supports at least part of the liquid container; and a casing that accommodates the liquid container and is provided with the support portion, wherein the casing includes:

a bottom wall; and an opening portion formed above the bottom wall the liquid container being detachably accommodated into the casing through the opening portion.

6. The liquid supply apparatus according to claim 5, wherein the casing further includes a lid member movable between open and closed positions, the lid member closing the opening portion when the lid member is positioned at the closed position.

7. The liquid supply apparatus according to claim 5, wherein the casing further includes a front wall, and the end portion of the liquid container is oriented at an angle that intersects the front wall when viewed in a direction from the opening portion toward the bottom wall.

8. A liquid supply apparatus for supplying liquid to a liquid-jet head, comprising:

a liquid container that has a liquid containing portion at least partially having a flexible portion, and a liquid outlet portion in communication with the liquid containing portion; and a support portion that supports at least part of the liquid container;

wherein the liquid outlet portion of the liquid container is formed at an end portion of the liquid containing portion, and the liquid container includes, at an end portion thereof on the side where the liquid outlet portion is formed, a liquid container support portion that is supported by the support portion.

9. The liquid supply apparatus according to claim 8, wherein the liquid container support portion includes a support member that can be engaged with the end portion, and the liquid container is supported by means of the support member by the support portion of the casing.

10. The liquid supply apparatus according to claim 9, wherein the support member supports the liquid outlet portion.

11. The liquid supply apparatus according to claim 10, wherein the support member supports the liquid containing portion on both sides of the liquid outlet portion.

12. The liquid supply apparatus according to claim 8, wherein the liquid container is supported and suspended, at the end portion thereof on the side where the liquid outlet portion is formed, from the support portion.

13. A liquid supply apparatus for supplying liquid to a liquid-jet device, comprising:

a liquid container that has a liquid containing portion at least partially having a flexible portion, and a liquid outlet portion in communication with the liquid containing portion;

a support portion that supports at least part of the liquid container; a liquid inlet portion that can be connected to the liquid outlet portion; and a casing that accommodates the liquid container and is provided with the support portion;

wherein the casing includes:

a first peripheral wall facing the liquid-jet device;

a second peripheral wall facing the first peripheral wall;

a third peripheral wall and a fourth peripheral wall intersecting the first peripheral wall and the second peripheral wall;

a bottom wall intersecting the first peripheral wall, the second peripheral wall, the third peripheral wall, and the fourth peripheral wall;

an opening portion provided above the bottom wall; and a see-through portion through which a state of the flexible portion of the liquid containing portion displaced as the liquid inside the liquid container is consumed can be seen; and a distance between the first peripheral wall and the second peripheral wall of the casing is smaller than a width at an end portion of the liquid container on the side where the liquid outlet portion is formed.

14. A liquid container for containing liquid that is to be used by a liquid-jet device, comprising:

a liquid outlet portion through which the liquid flows to the outside;

a liquid containing portion that has a flexible wall, an end portion of which is provided with the liquid outlet portion; and a hanger member that can be engaged with the end portion at which the liquid outlet portion is provided, wherein the hanger member supports the liquid containing portion on both sides of the liquid outlet portion.

15. The liquid container according to claim 14, further comprising a channel in communication with the liquid outlet portion and extending to the side opposite from the end portion of the liquid containing portion.

16. A liquid container, that can be connected to a liquid-jet device, comprising:

a liquid containing portion that at least partially has a flexible portion;

a liquid outlet portion that is provided at an end portion of the liquid containing portion, and is in communication with an internal portion of the liquid containing portion; and a support member that supports the liquid outlet portion;

wherein the liquid outlet portion includes a flange portion, the support member includes a recess portion having a width smaller than that of the flange portion, and the liquid outlet portion is inserted, at a portion thereof closer to the liquid containing portion than the flange portion is, into the recess portion.

17. The liquid container according to claim 16, wherein the support member includes two support members, and the end portion of the liquid containing portion is disposed in a gap between the two support members.

18. The liquid container according to claim 16, wherein the support member supports the liquid outlet portion such that, when the liquid container is connected to the liquid-jet device, the liquid outlet portion is positioned on an upper side in the gravity direction of the liquid containing portion.

19. A liquid container that can be connected to a liquid-jet device, comprising:

a liquid containing portion that at least partially has a flexible portion;

a liquid outlet portion that is provided at an end portion of the liquid containing portion, and is in fluid communication with an internal portion of the liquid containing portion; and a support member that supports the liquid outlet portion, wherein the liquid outlet portion includes a flange portion, the support member includes a recess portion having a width smaller than that of the flange portion, and the liquid outlet portion is inserted, at a portion thereof closer to the liquid containing portion than the flange portion is, into the recess portion.

20. The liquid container according to claim 19, wherein the support member includes two support members, and the end portion of the liquid containing portion is disposed in a gap between the two support members.

* * * * *